US005404717A

United States Patent [19]

Nogi et al.

[11] Patent Number: 5,404,717

[45] Date of Patent: Apr. 11, 1995

[54] METHOD AND SYSTEM FOR CONTROLLING INTERNAL COMBUSTION ENGINE WITH AIR PUMP

[75] Inventors: Toshiharu Nogi; Minoru Ohsuga, both of Katsuta; Jun'ichi Yamaguchi, Hitachi; Yoshiyuki Tanabe, Katsuta; Keigo Naoi, Katsuta; Masayuki Shizuka, Katsuta; Kazuo Tahara, Hitachi, all of Japan

[73] Assignee: Hitachi, Ltd., Tokyo, Japan

[21] Appl. No.: 24,246

[22] Filed: Mar. 1, 1993

[30] Foreign Application Priority Data

Feb. 28, 1992 [JP] Japan ..... 4-042759

[51] Int. Cl.[6] ..... F01N 3/22

[52] U.S. Cl. ..... 60/274; 60/284; 60/286; 60/289; 60/300; 123/179.18; 123/531

[58] Field of Search ..... 60/274, 284, 286, 289, 60/290, 303, 300; 123/179.18, 531

[56] References Cited

U.S. PATENT DOCUMENTS 4,043,310 8/1977 Ichimiya ..... 123/179.18
4,481,424 11/1984 Hattori et al. .
5,086,746 2/1992 Albertson .
5,136,842 8/1992 Achleitner ..... 60/276
5,205,120 4/1993 Oblander ..... 123/531

FOREIGN PATENT DOCUMENTS 0115643 8/1984 European Pat. Off. .
145316 8/1984 Japan ..... 60/286
1-253565 10/1989 Japan .
2-107763 8/1990 Japan .
2081992 2/1982 United Kingdom .

OTHER PUBLICATIONS

European Search Report, "*The Hague*", completed Jun. 10, 1993.

*Primary Examiner*—Douglas Hart
*Attorney, Agent, or Firm*—Evenson, McKeown, Edwards & Lenahan

[57] ABSTRACT

The present invention relates to a control circuit for use in an internal combustion engine having a cranking device and an air pump driven by a starter motor. The control circuit comprises a first circuit for supplying a power to the starter motor and the cranking device, a second circuit for terminating power supply for the cranking device with maintaining power supply for the starter motor, and a control unit for selectively switching between the first and second circuits.

37 Claims, 35 Drawing Sheets

SUC : SUCTION STROKE
CMP : COMPRESSION STROKE
COB : COMBUSTION STROKE
EXH : EXHAUST STROKE

| CYLINDER No. | | | | | | |
|---|---|---|---|---|---|---|
| #1 | SUC | CMP | COB | EXH | SUC | CMP |
| 3 | EXH | SUC | CMP | COB | EXH | SUC |
| 4 | COB | EXH | SUC | CMP | COB | EXH |
| 2 | CMP | COB | EXH | SUC | CMP | COB |

METHOD AND SYSTEM FOR CONTROLLING INTERNAL COMBUSTION ENGINE WITH AIR PUMP

BACKGROUND OF THE INVENTION

In exhaust emission control systems for internal combustion engines, there are some systems which promote catalytic reaction by supplying secondary air into exhaust manifolds or catalytic converters. On the other hand, fuel atomizers are employed for improving fuel economy and engine output performance. There are some atomizers which inject air from an air pump around fuel injection valves. The present invention relates to a method and a system for controlling an internal combustion engine with an air pump. More specifically, the invention relates to a driving of the air pump by means of a starter motor.

JP-A-1-253565 as unexamined publication for Japanese Patent Application filed on Apr. 4, 1988, discloses a system for atomizing fuel by injecting an air fed from an electric air pump to a fuel supplied into an intake manifold through one or more fuel injection valves.

Also, JU-A-2-107763 as unexamined publication for Japanese Utility Model Application filed on Feb. 15, 1989, discloses an air pump which is driven by a starter motor for cranking the internal combustion engine during cranking period and is driven by an engine revolution after starting-up of the engine.

In the field of the internal combustion engine, it have been known to supply the air by means of the electric motor which is driven by a sophisticated motor and to employ an air pump which is driven by a starter motor or the engine per se in place of the electric air pump.

However, when the electric air pump is employed, it may encounter a problem of an excessive load on a battery by driving of the electric air pump during cranking of the engine to make revolution of the starter motor unstable and to cause difficulty in starting up of the engine.

In contrast to this, in case of the air pump driven by the starter motor, an electrical and a mechanical loss can be reduced for elimination of the sophisticated motor for driving the air pump and the load on the battery can be reduced to make the revolution of the starter motor much stable.

On the other hand, since the starter motor is generally designed to be stopped once the engine is started up through cranking. Another source of power for driving the air pump becomes necessary after termination of driving of the starter motor.

It is possible to consider a revolution torque of the engine per se as another source of the power for driving the air pump. However, in such case, the power transmission path necessarily becomes complicate for necessity of switching between the starter motor and a rotary output shaft of the engine. Therefore, this solution cannot be practical.

SUMMARY OF THE INVENTION

It is an object of the present invention to provide a novel method and a system as well as a control circuit for an internal combustion engine which incorporates an air pump driven by a starter motor.

A control circuit, according to the present invention, comprises first circuit for supplying a power to the starter motor and the cranking device, second circuit for terminating power supply for the cranking device with maintaining power supply for the starter motor and control means for selectively switching between the first and second circuits.

According to the present invention, cranking is terminated once the engine is started up but the starter motor can be maintained in revolution to maintain driving of the air pump by the starter motor while the starter motor is held in revolution.

According to the present invention, it is unnecessary to modify a drive mechanism for the air pump. Also, it does not require sophisticated air pump driving motor. With the present invention, the air pump can be driven even after starting up of the engine with simple circuit construction.

Other objects and technical advantages of the present invention will become clear from disclosure of the embodiments of the invention given herebelow with reference to the drawings.

DESCRIPTION OF THE PREFERRED EMBODIMENTS

Figure 1:
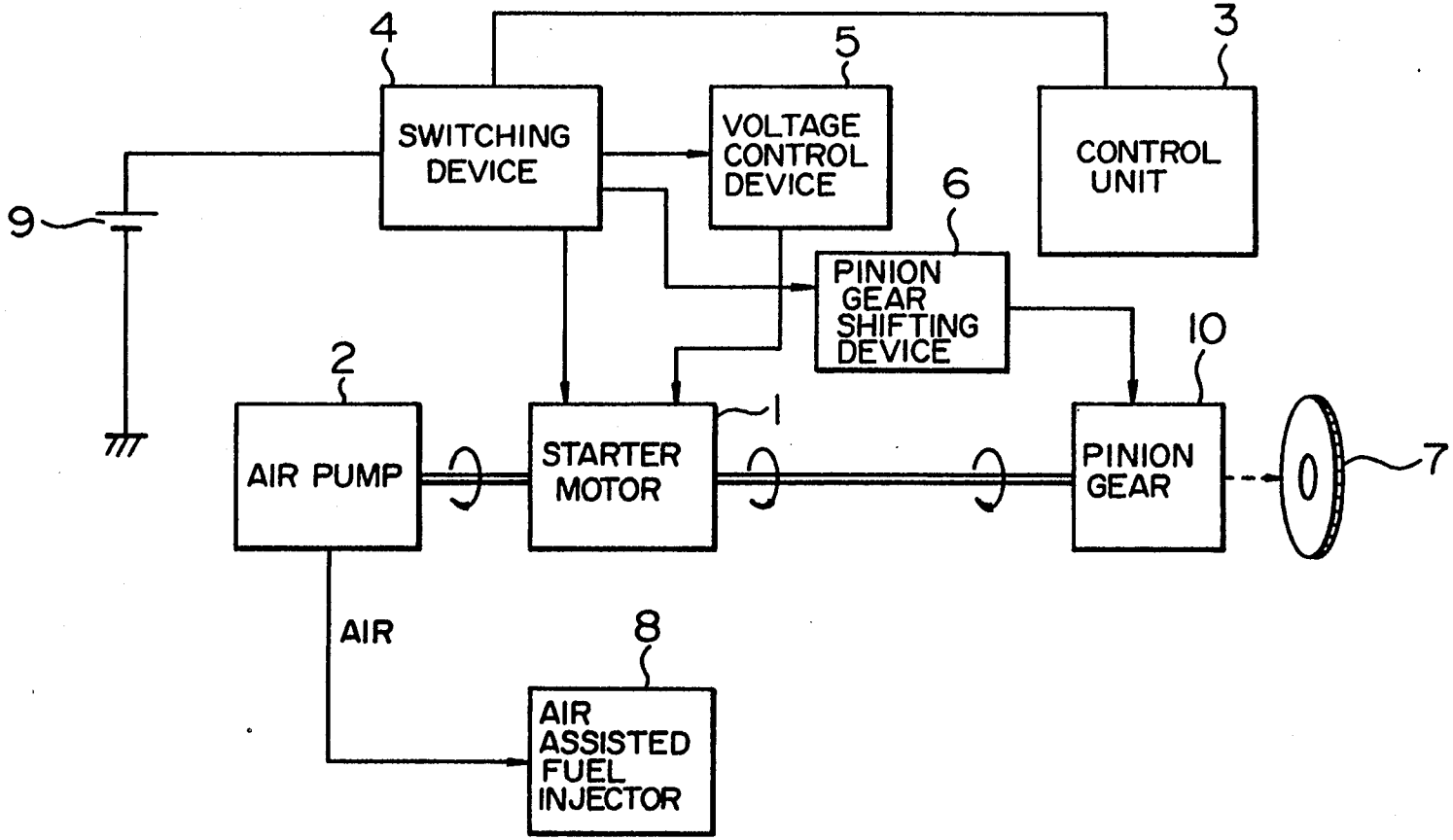
FIG. 1 is a block diagram showing a basic construction of a control system according to the present invention.

FIG. 1 is a block diagram of an embodiment of a control system for an internal combustion engine according to the invention. A rotary shaft of an air pump 2 is coupled with a rotary shaft of a starter motor 1. The starter motor 1 is driven for revolution in response to a supply of a voltage of a battery 9 via a switching device 4. A control unit 3 is responsive to turning on of a cranking switch to command to the switching device 4 for establishing connection between the battery 9 and the starter motor 1. In the alternative, the switching device 4 may be mechanically cooperated with the cranking switch so as to establish the electric connection between the battery 9 and the starter motor 1 in response to turning 0N of the cranking switch. In turn, the switching device 4 drives a pinion gear shifting device 6, such as an electromagnetic actuator or so forth, for engaging a pinion gear 10 rigidly fixed on the rotary shaft of the starter motor, with a ring gear 7 which is coupled with a rotary shaft of an engine (not shown), for cranking the engine, in response to turning ON of the cranking switch.

Once the engine is started up, the pinion gear 10 is released from the ring gear. At the same time, the switching device 4 maintains connection between the battery 9 and the starter motor 1 according to a command from the control unit 3 so as to maintain revolution of the starter motor. While the starter motor 1 is maintained in revolution, the air pump 2 is also driven to supply a discharge air to an air assisted fuel injection valve 8 (hereinafter simply referred to as "injection valve"). The injection valve 8 is constructed to inject the air around a fuel injection nozzle. By injecting the air toward an injected fuel from the fuel injection nozzle, atomization of the fuel can be promoted or assisted. Also, it is possible to supply the discharge air of the air pump 2 to a not shown catalytic converter. After cranking, the switching device 4 connects the battery 9 to the starter motor 1 via a voltage control device 5 which includes a resistor and so forth, according to a command from the control unit 3, to limit a motor current. The control unit 3 may be constructed with a microcomputer available in the market.

Figure 2:
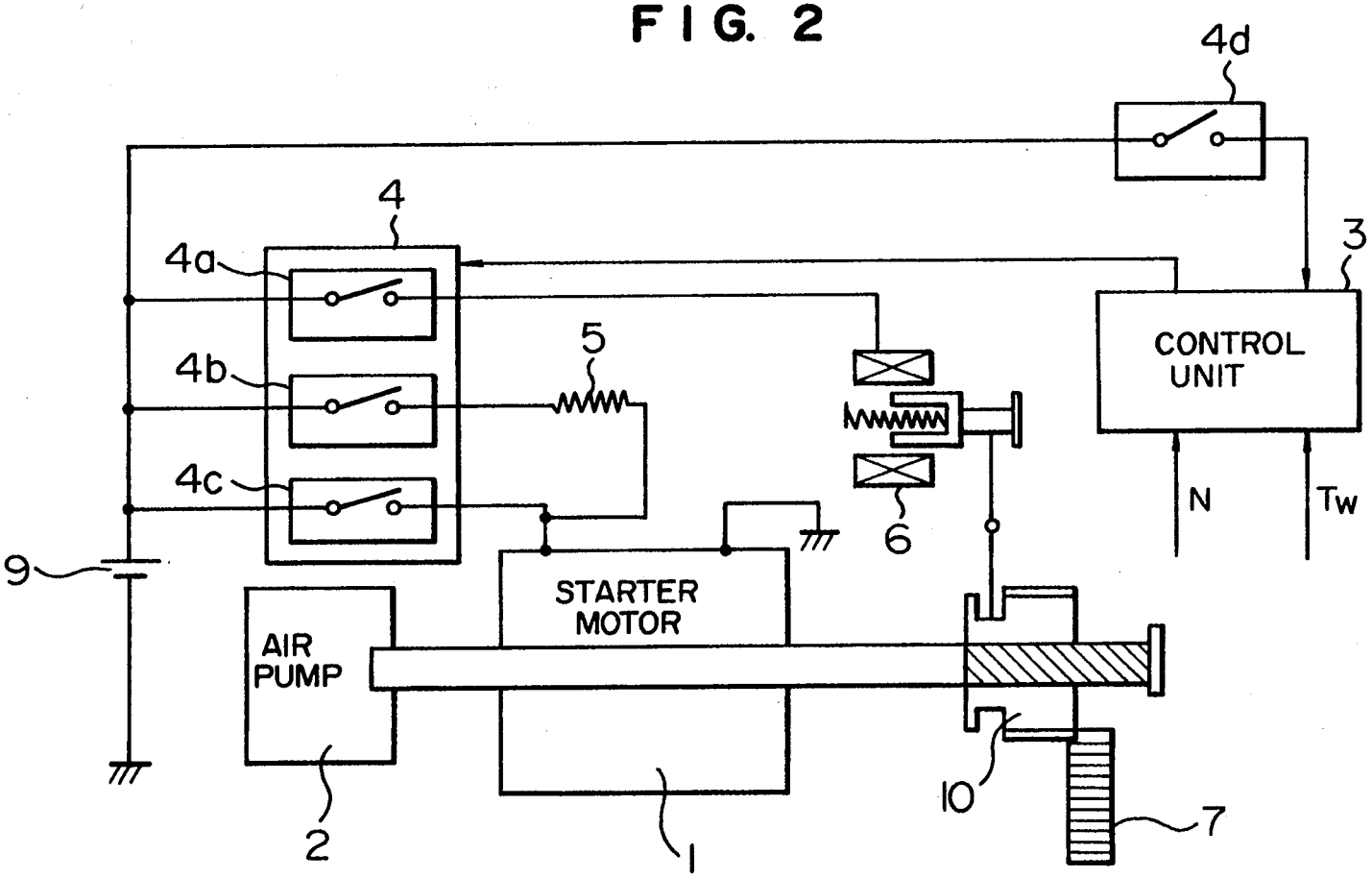
FIG. 2 is a schematic block diagram showing an embodiment of a control circuit for a starter motor and an air pump.

FIG. 2 shows an example of a concrete control circuit for the air pump 2 in FIG. 1. The air pump can be of any type, e.g. vane type, diaphragm type, scroll type or so forth. The diaphragm type air pump is preferred, so that the air to be supplied to the injection valve 8 is pure enough.

When the cranking switch 4*d* is turned on by a driver or the control unit 3, the control unit 3 commands to the switching device 4 to close switches 4*a* and 4*c* and open switch 4*b* in response thereto. When the switch 4*a* is closed, the battery 9 is connected to the electromagnetic actuator of the pinion gear shifting device 6. The pinion gear shifting device 6 receiving supply of the battery voltage engages the pinion gear 10 with the ring gear 7. When the switch 4*b* is closed, the battery 9 is connected to the starter motor 1. Then, the starter motor 1 drives the pinion gear 10 and the air pump 2. A cranking switch 4*d* corresponds normally to starting contacts of an ignition switch. However, it should be noted that the switch 4*d* may be an electronic switching circuit incorporated in the control unit 3.

Once, the engine is started up by cranking, the control unit 3 commands to the switching device 4 to open the switches 4*a* and 4*c* and close the switch 4*b* . When the switch 4*b* is closed, the battery 9 is connected to the starter motor 1 through a resistor 5. Then, the pinion gear 10 is released from the ring gear 7.

The control unit 3 may control the switching device 4 depending upon parameters indicative of the engine operating condition, such as an engine speed N, an engine coolant temperature Tw, a catalyst temperature and so forth, in addition to the state of the cranking switch 4*d* . On the other hand, the switching device may incorporate a mechanism for mechanical cooperative operation with operation of the cranking switch 4*d*

. Concrete embodiments incorporating these elements will be discussed later.

Figure 3:
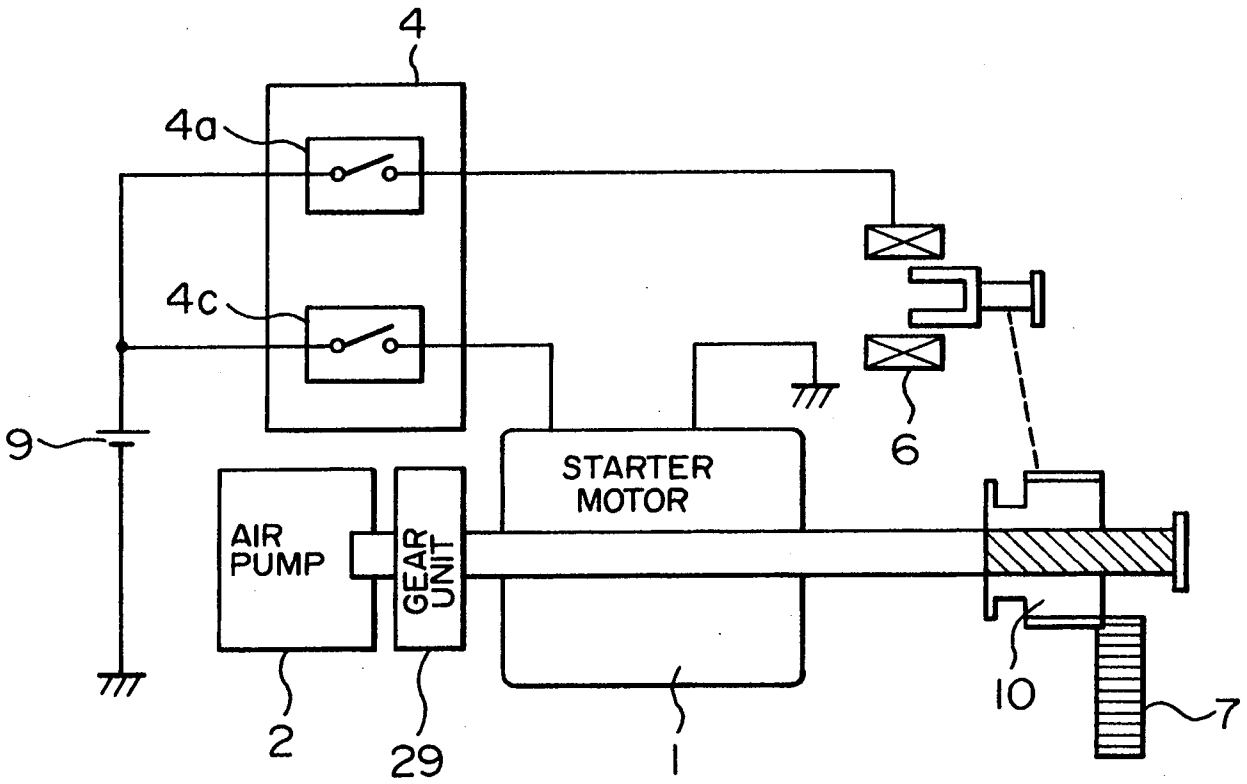
FIG. 3 is a schematic block diagram showing another embodiment of a control circuit for the starter motor and the air pump.

FIG. 3 shows another embodiment of the present invention. A voltage is supplied from the battery 9 to the starter motor 1 and the pinion gear shifting device 6 through the switching device 4. The battery voltage is supplied to the starter motor 1 bypassing the resistor while the switch 4*a* is held ON. During the period, in which the switch 4*a* is held ON, the electromagnetic actuator 6 is maintained in the active state to maintain the pinion gear 10 in engagement with the ring gear 7. This can be achieved with simple construction. However, while the pinion gear 10 is disengaged from the ring gear, a greater current may flow through the starter motor 1 to make it difficult to maintain the air pump 2 in operation. Therefore, it becomes necessary to drive the air pump 2 only while the starter motor 1 is active, or, in the alternative, to limit a driving period of the starter motor 1.

A speed change gear unit 29 is interposed between the starter motor 1 and the air pump 2. The speed change gear unit 29 transmits the output torque of the starter motor 1 with changing a speed to an optimum speed, at which the air pump 2 operates with the highest efficiency. In FIG. 3, the control unit 3 is neglected from illustration. The switching device 4 may be controlled by the control unit 3, or provided with a mechanism to cooperate with the cranking switch 4*d*.

Figure 4:
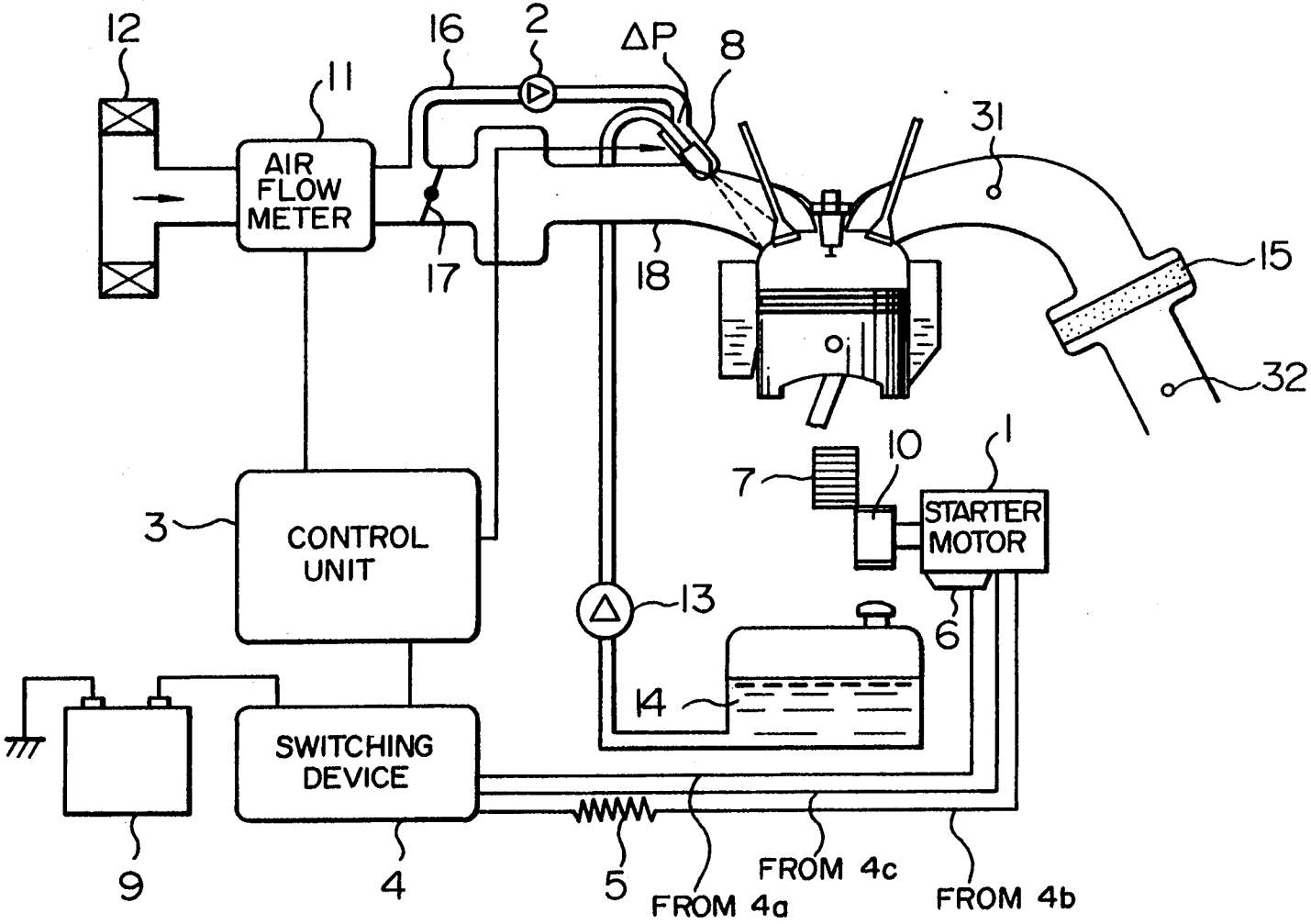
FIG. 4 is a schematic block diagram showing a further embodiment of a control circuit for the starter motor and the air pump.

FIG. 4 illustrates an example, in which the present invention is applied for an induction port fuel injection system of a gasoline engine. The air introduced through an air cleaner 12 is measured by an air flow meter 11 and subsequently passes through a throttle valve 17 to be introduced into engine cylinders via an intake manifold 18. The control unit 3 calculates a fuel supply amount necessary for combustion on the basis of an air flow rate indicative signal from the air flow meter 11. The fuel in the determined amount is injected into the intake manifold 18 through one or more air assisted fuel injection valves 8. The air assisted fuel injection valve 8 is connected to a fuel system including a fuel pump 13 sucking the fuel in fuel tank 14 and feeing the same to the air assisted fuel injection valve 8 at a predetermined pressure. To the tip end of the air assisted fuel injection valve, the air for atomization of the fuel is supplied from the downstream of the air flow meter 11 in an air induction system through an air passage 16 and the air pump 2. The air pump 2 is designed to be driven by revolution of the starter motor 1. Since the atomization air is measured by the air flow meter 11, the atomization air will never serve as an error component in calculation of the fuel supply amount. The battery 9 is connected to the starter motor 1 through the switching device 4. By the switching device 4, the electromagnetic actuator 6 is actuated to establish engagement between the pinion gear 10 and the ring gear 7 for cranking of the engine. The switch 4*c* of the switching device 4 is then closed to supply the power to the starter motor 1. After completion of cranking, the electromagnetic actuator 6 is turned off to release the pinion gear 10 from the ring gear 7. Judgement of starting up of the engine can be made by detecting either one of the engine speed N or a battery voltage increasing across a predetermined value. In response to this, the voltage is supplied to the starter motor 1 through the resistor 5. By this, the excess current is prevented from flowing through the starter motor to eliminate heating of the starter motor 1 and thus to avoid shortening of the life thereof.

It should be noted that disposed in the exhaust pipe is a catalytic converter 15.

Figure 5:
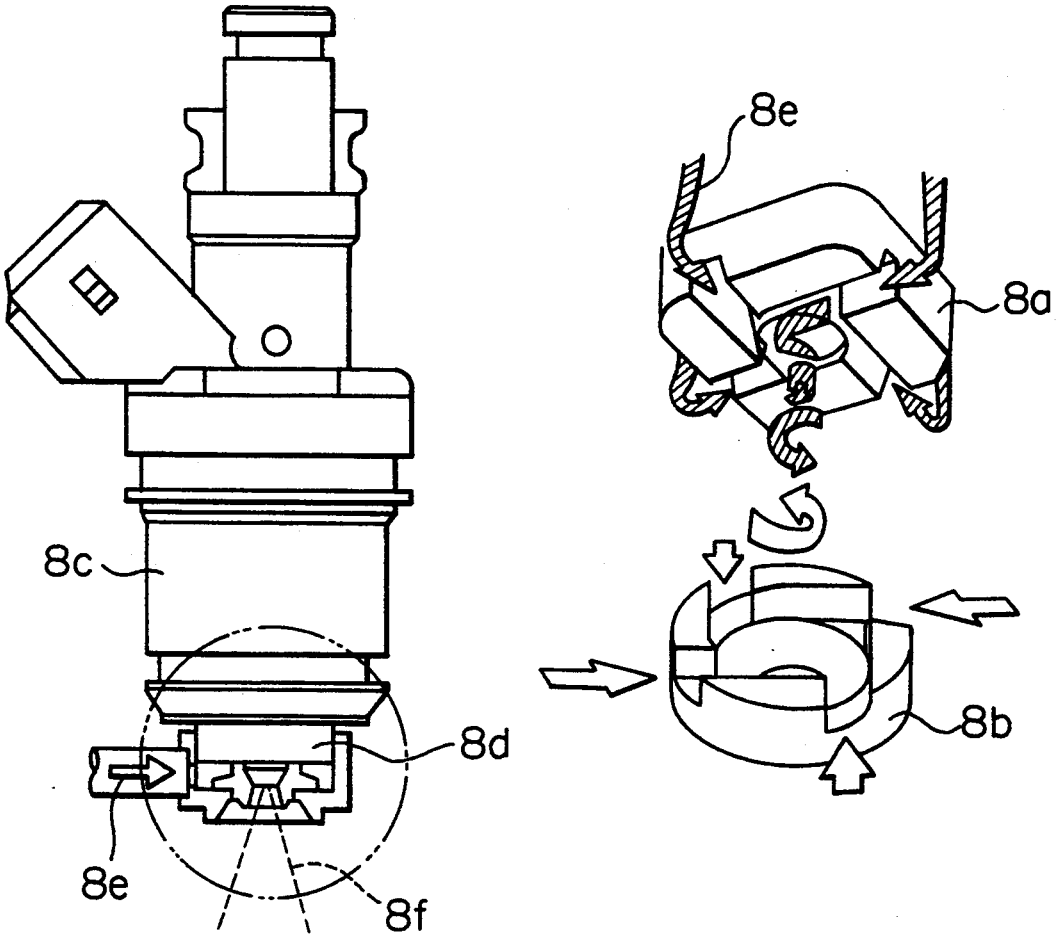
FIG. 5 is a detailed illustration of an air assisted fuel injection valve.

FIG. 5 shows one example of a construction of the air assisted fuel injection valve 8. An air orifice 8*d* is mounted on the tip end of a fuel injection valve body 8*c* . The atomization air supplied from the air pump 2 collides to the fuel injected from the fuel injection valve body for promoting atomization of the fuel. A fuel nozzle 8*a* may be designed to induce swirl motion for fuel droplets, for example, to form a fuel film so that fuel can be atomized even without the atomization air. Providing an air orifice 8*b* at the position downstream of the fuel nozzle, the atomization air is collided on the fuel film to further promote atomization of the fuel. In this case, it is possible to generate swirl flow of the atomization air in the opposite direction to the swirl direction of the fuel so as to increase a relative swirl velocity of the atomization air and the fuel for better atomization efficiency.

Figure 6:
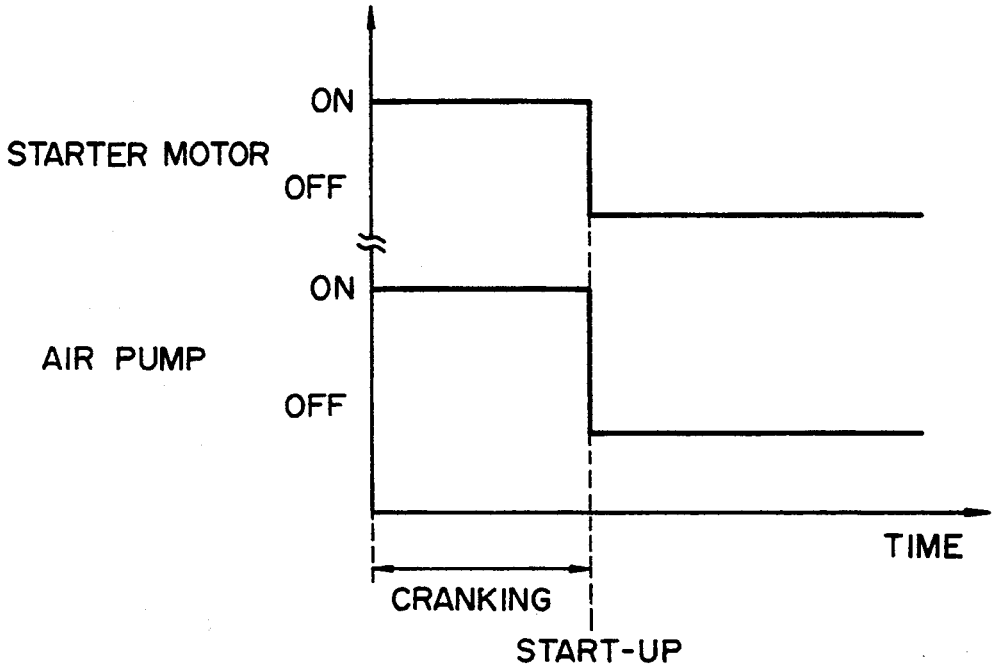
FIG. 6 is a timing chart showing process of control of the starter motor and the air pump.

FIG. 6 shows an example of operation diagram of the starter motor and the air pump. During cranking, the ring gear 7 and the pinion gear 10 are maintained in engagement. While the starter motor is in revolution (ON), the air pump is simultaneously driven (ON). During cranking, the air is supplied to the air assisted fuel injection valve 8 by the air pump for promoting atomization of the fuel for better engine start-up characteristics. In this case, the connection of the air pump to the starter motor is taken place in conjunction with establishment of engagement between the ring gear and the pinion gear. However, in this case, the air pump is driven only during cranking.

Figure 7:
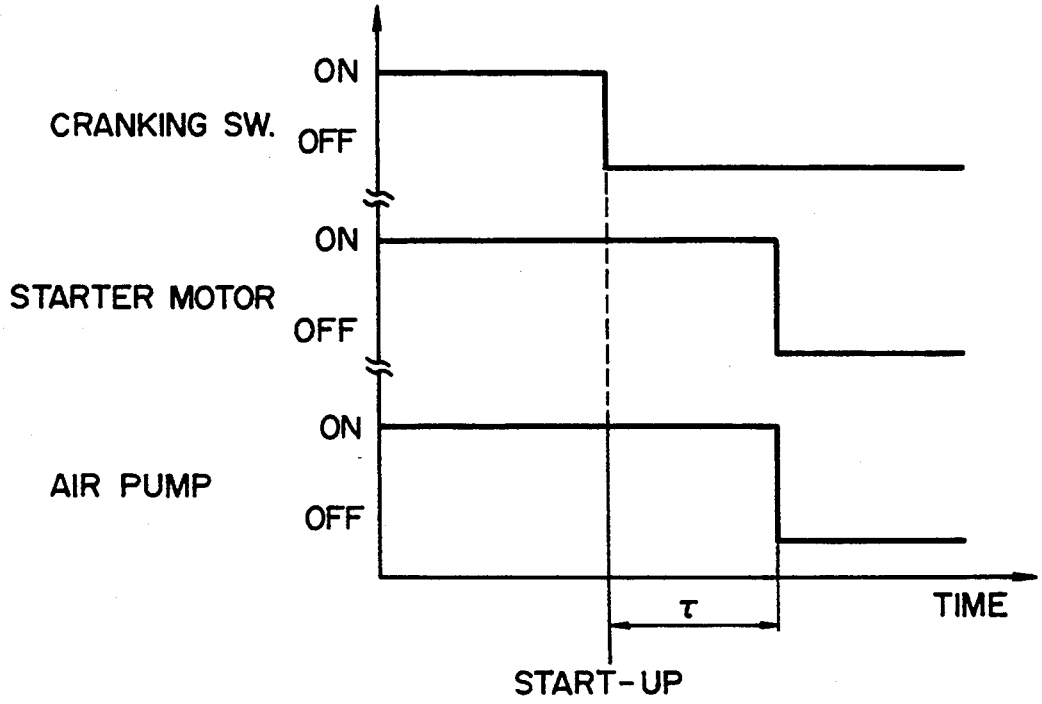
FIG. 7 is a timing chart showing process of control of the starter motor and the air pump.

FIG. 7 shows another example of operation diagram of the starter motor and the air pump. During cranking, the ring gear 7 and the pinion gear 10 are maintained in engagement. While the starter motor is in revolution (ON), the air pump is simultaneously driven (ON). During cranking, the air is supplied to the air assisted fuel injection valve 8 by the air pump for promoting atomization of the fuel for better engine start-up characteristics. Subsequently, after completion (OFF) of cranking, the starter motor is maintained in revolution for a given period $\tau$ for keeping the air pump 2 driving. During this period $\tau$, the starter motor 1 is supplied the battery voltage via the resistor. Since temperatures of the engine and the intake manifold are flow at immediately after start-up, atomization of the fuel is necessary until warming-up of the engine is completed. For this reason, it is preferable to maintain the air pump in driving even after achieving complete combustion.

Figure 8:
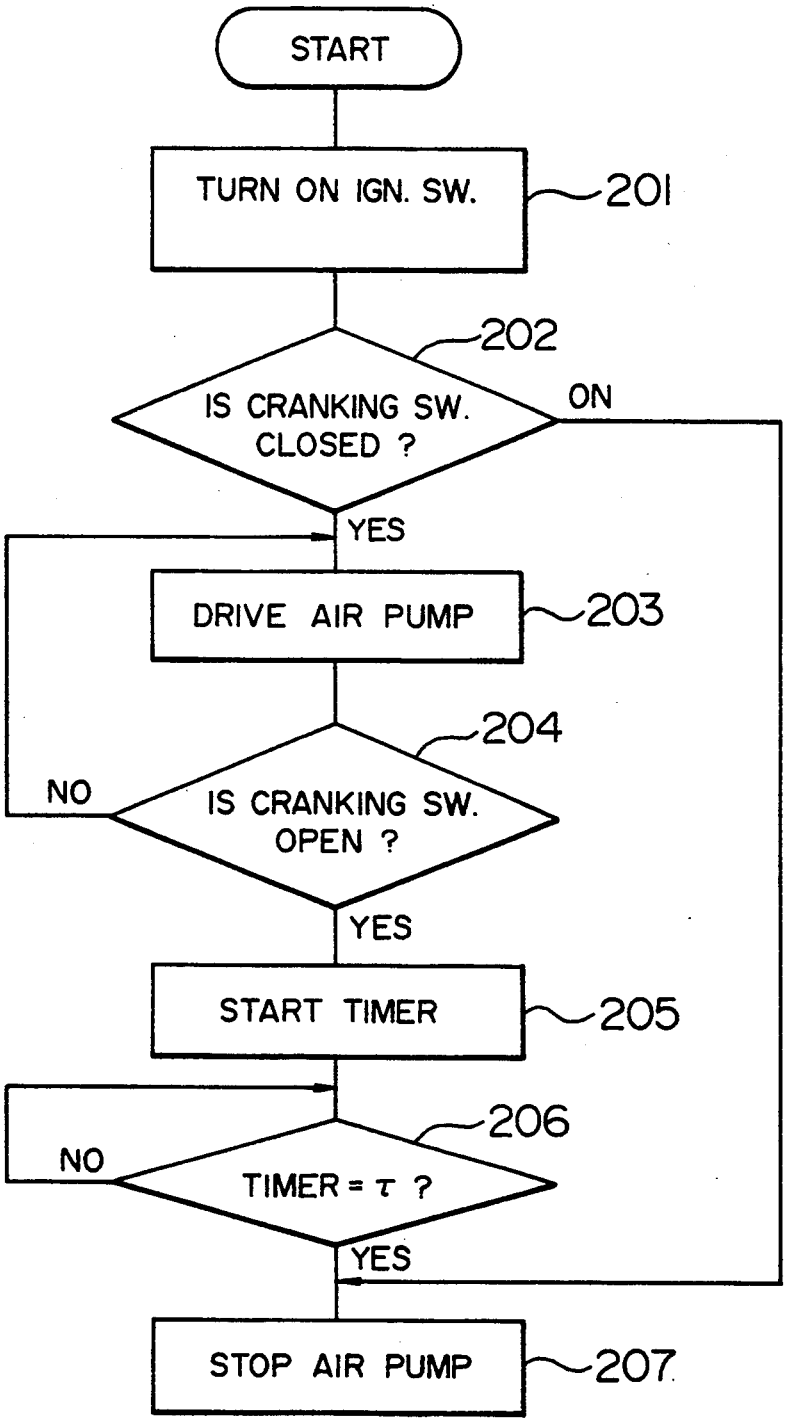
FIG. 8 is a flowchart of process for controlling the starter motor and the air pump.

The operation illustrated in FIG. 7 is achieved by the control of the control unit 3 for the switching device 4. FIG. 8 shows one example of a control program for implementing the operation in FIG. 7 in the either control circuit of FIG. 2 or FIG. 3. At a step 201, a driver turns an ignition key to turn on an ignition switch. At a step 202, check is performed whether cranking switch 4*d* is in the closed position. When the cranking switch 4*d* is in the closed position, the switches of the switching device 4 are controlled to connect the starter motor 1 to the battery 9 and to drive the air pump 2 at a step 203. Then, check is performed whether the cranking switch is in open position at a step 204. When the open position of the cranking switch is judged, a timer is initiated to measure an elapsed time at a step 205. Then, at a step 206, check is performed whether the elapsed time measured by the timer reaches the given period $\tau$. When the given period $\tau$ is elapsed, the switches of the switching device 4 are controlled to disconnect the starter motor 1 from the battery 9 to terminate driving of the air pump 2 (and revolution of the starter motor 1) m at a step 207. It should be noted that, although it is not illustrated in the flowchart, the switching device 4 is controlled to disconnect the pinion gear shifting device 6 from the battery 9 when the judgement is made that the cranking switch **4*d* is in the open position at the step 204**.

Figure 9:
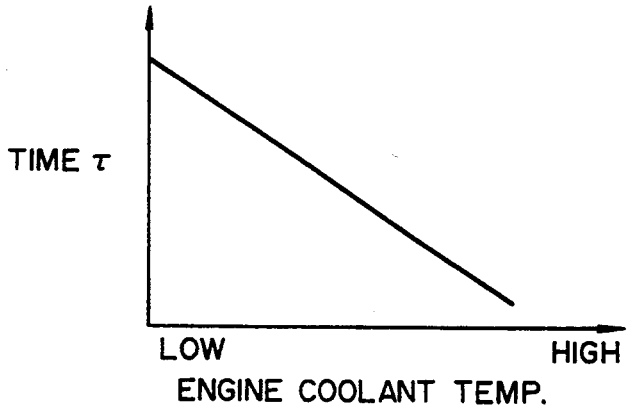
FIG. 9 is a graph showing a relationship between an engine coolant temperature and an operation period of the air pump.

FIG. 9 shows a relationship between the engine coolant temperature Tw and the given period $\tau$. The given period $\tau$ will be shorter at higher engine coolant temperature Tw. This relationship will be preliminarily derived through experiments for obtaining better fuel economy and exhaust emission characteristics. The relationship thus derived is set in a memory (not shown) in the control unit 3.

Figure 10:
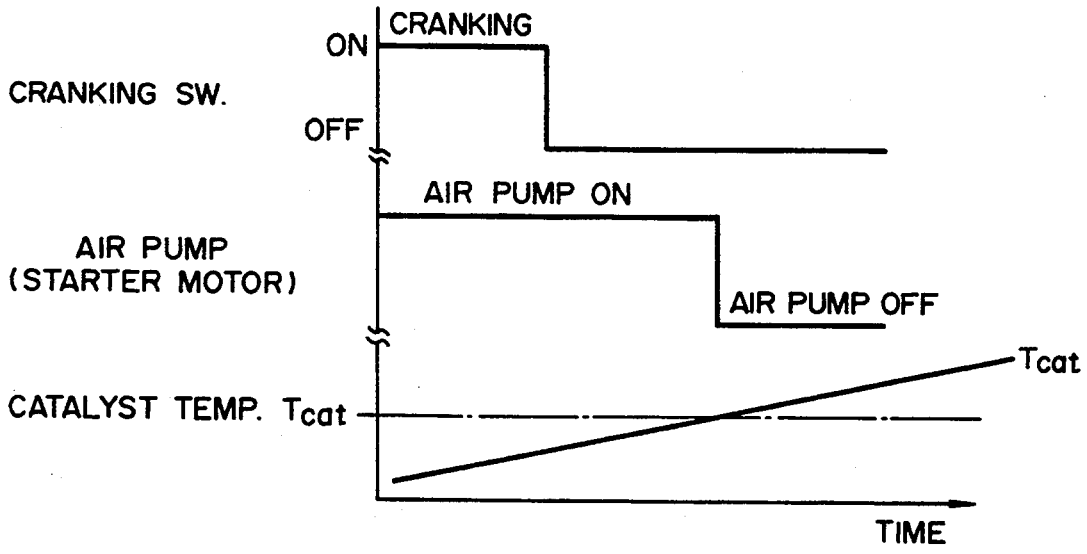
FIG. 10 is a flowchart of process for controlling the starter motor and the air pump.

FIG. 10 shows a further operation diagram of the starter motor 1 and the air pump 2. During cranking, the ring gear 7 and the pinion gear 10 are maintained in engagement. While the starter motor is in revolution (ON), the air pump is simultaneously driven (ON). During cranking, the air is supplied to the air assisted fuel injection valve 8 by the air pump for promoting atomization of the fuel for better engine start-up characteristics. Subsequently, after completion (OFF) of cranking, the air pump 2 is maintained in driving state until the catalyst temperature is risen across a predetermined set temperature $T_{cat}$. At this time, the starter motor 1 is connected to the battery 9 through the resistor. Immediately after starting up, the temperatures of the engine, the intake manifold and the catalyst are low, the catalyst cannot be sufficiently active. Therefore, until the catalyst becomes sufficiently active, it is necessary to promote atomization of the fuel and whereby to reduce non-combustion component in the exhaust gas. Therefore, the air pump is maintained in driving state even after achievement of the complete combustion. In such case, a temperature sensor is provided for the catalyst. In the alternative, active state of the catalyst may be judged by providing oxygen sensors 31 and 32 at upstream and downstream of the catalytic converter and monitoring outputs of the oxygen sensors 31 and 32, to maintaining driving of the air pump until satisfactorily active state of the catalyst is detected. Judgement of the temperature condition or active state of the catalyst is made by the control unit 3.

Figure 11:
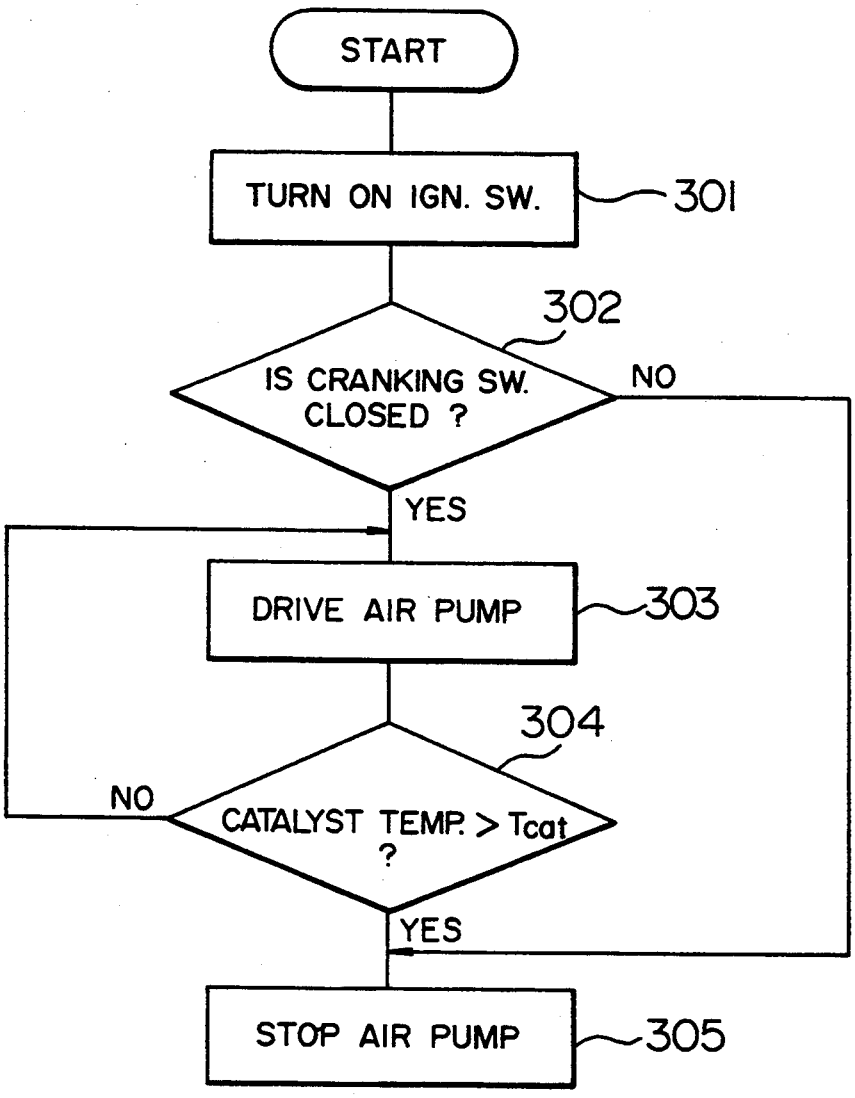
FIG. 11 is a flowchart of process for controlling the starter motor and the air pump.

FIG. 11 shows one example of a control program for implementing the operation in FIG. 10 in the either control circuit of FIG. 2 or FIG. 3. At a step 301, a driver turns an ignition key to turn on an ignition switch. At a step 302, check is performed whether cranking switch **4*d* is in the closed position. When the cranking switch 4*d* is in the closed position, the switches of the switching device 4 are controlled to connect the starter motor 1 to the battery 9 and to drive the air pump 2. Then, check is performed whether the catalyst temperature is higher than or equal to the predetermined set temperature $T_{cat}$ at a step 304. When the catalyst temperature higher than or equal to the set temperature $T_{cat}$ is judged, the switches of the switching device 4 are controlled to disconnect the starter motor 1 from the battery 9 to terminate driving of the air pump 2 (and revolution of the starter motor 1), at a step 305. It should be noted that, although it is not illustrated in the flowchart, the switching device 4 is controlled to disconnect the pinion gear shifting device 6 from the battery 9 when the judgement is made that the cranking switch 4*d* is in the open position after the step 302**.

Figure 12:
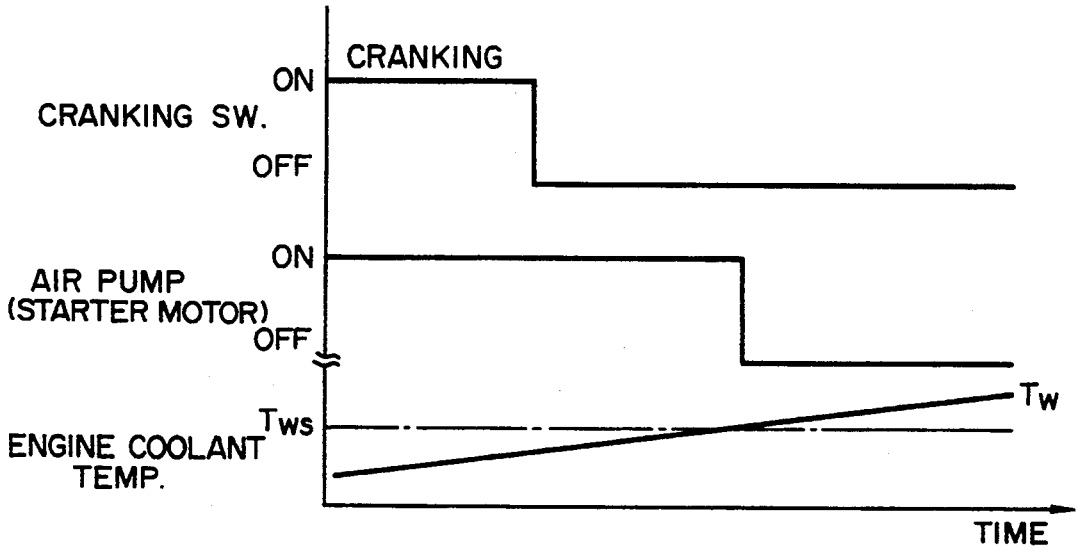
FIG. 12 is a flowchart of process for controlling the starter motor and the air pump.

FIG. 12 shows a yet further operations of the starter motor 1 and the air pump 2. During cranking, the ring gear 7 and the pinion gear 10 are maintained in engagement. While the starter motor is in revolution (ON), the air pump is simultaneously driven (ON). During cranking, the air is supplied to the air assisted fuel injection valve 8 by the air pump for promoting atomization of the fuel thereby to improve startability of the engine. Subsequently, after completion of cranking (OFF), the air pump 2 is maintained in driving state until the engine coolant temperature is risen across a predetermined set temperature Tws. During this period, the starter motor 1 is connected to the battery 9 through the resistor. Immediately after starting up, the temperatures of the engine, the intake manifold and the intake valves are low, it is necessary to atomize the fuel until the engine is warmed up. Therefore, the air pump is maintained in driving state even after achievement of complete combustion while the engine coolant temperature is low.

The control program for implementing the operation of FIG. 12 in the control circuit of FIG. 2 or FIG. 3 is substantially the same as that illustrated in the flowchart of FIG. 11 with replacing the step 304 with a step for making judgement whether the engine coolant temperature is higher than or equal to Tws. Accordingly, illustration of the flowchart is neglected.

In the system such as illustrated in FIG. 4, the air can be introduced into the injection valve 8 through the air passage 15 and a gap in the air pump due to vacuum pressure in the intake manifold (a pressure difference between the internal pressure of the intake manifold and the atmospheric pressure), even when the air pump is not driven. Accordingly, in an operation range where the load is relatively low and the vacuum pressure (pressure difference) is large, the sufficient amount of the air can be supplied to the injection valve 8. In the medium and high load operation ranges, the vacuum pressure (pressure difference) is decreased, and then the amount of air to be supplied to the injection valve 8 is reduced. It may be possible to drive the air pump 2 for increasing the air amount when the supply amount of the air to the injection valve 8 is small.

Figure 13:
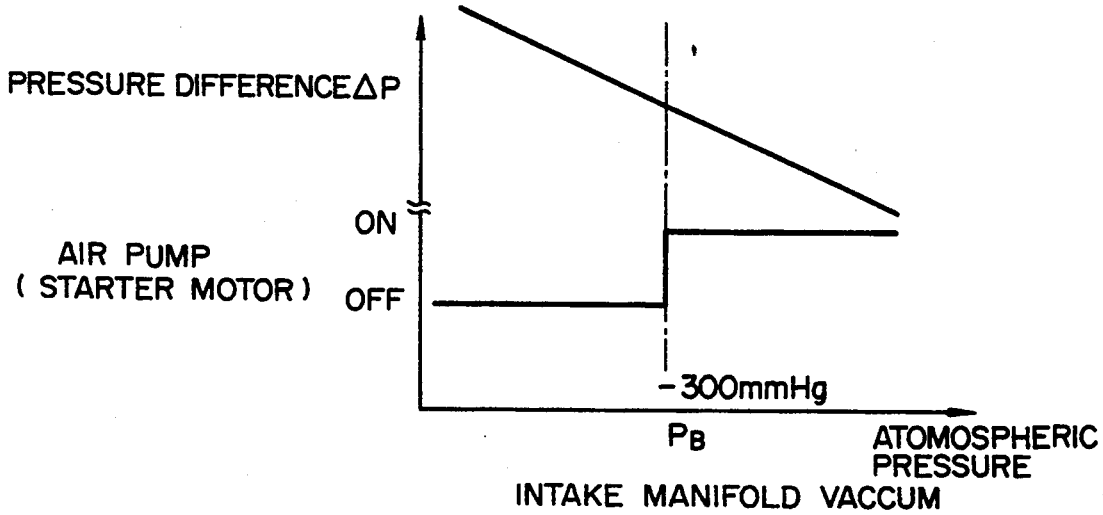
FIG. 13 is a flowchart of process for controlling the starter motor and the air pump.

FIG. 13 shows an example of a condition for operating the air pump. The pressure difference $\Delta P$ between the pressure at the outlet of the air pump and the internal pressure of the intake manifold becomes small in the extent to short the atomization air when the internal pressure $P_B$ of the intake manifold becomes higher than or equal to $-300$ mmHg (e.g. $-200$ mmHg). Then, the air pump 2 is required to be active (ON).

The control program for implementing the operation of FIG. 12 in the control circuit of FIG. 2 or FIG. 3 is substantially the same as that illustrated in the flowchart of FIG. 11 with replacing the step 304 with a step for making judgement whether the absolute value of the vacuum in the intake manifold is less than or equal to 300 mmHg. Accordingly, illustration of the flowchart is neglected.

Figure 14:
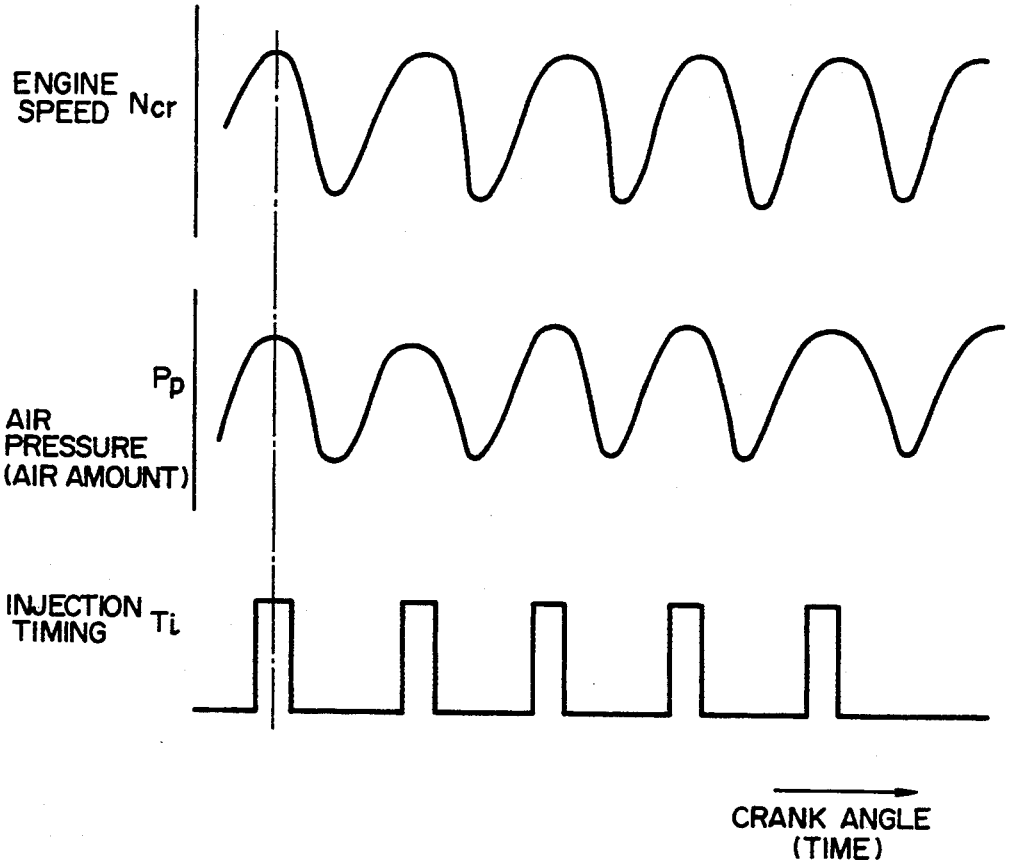
FIG. 14 is a timing chart showing a relationship between variation of an engine speed, an air pressure and an injection timing.

FIG. 14 shows an example of operation of the air pump in a four-cylinder engine. An engine speed $N_{cr}$ fluctuates during cranking. This is because high load on the starter motor at each compression stroke of the engine. Therefore, the engine speed is lowered at each of the compression strokes. When the engine speed is lowered, the displacement $P_p$ of the air pump is fluctuated since it is driven by the starter motor. Therefore, by selecting a fuel injection timing at a timing where the air supply amount of the air pump is large, the high fuel atomization efficiency can be assured. On the other hand, due to fluctuation of air discharge amount, an average air amount becomes smaller to make it possible to perform fuel atomization with smaller amount of air. This facilitates an air/fuel ratio control and permits setting of an engine idling speed at lower speed.

Figure 15:
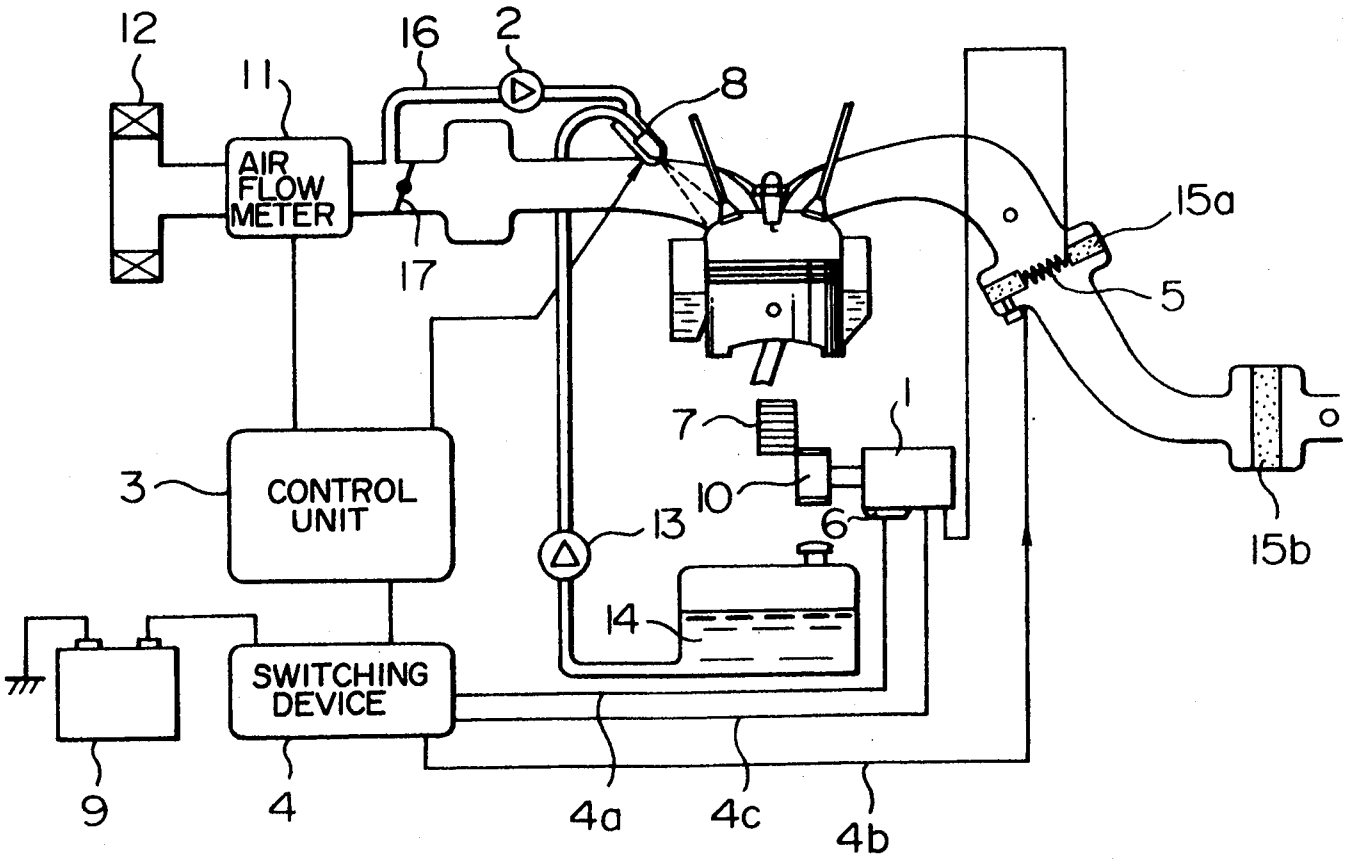
FIG. 15 is a schematic block diagram showing another embodiment of a control circuit for the starter motor and the air pump.

FIG. 15 shows an example of application of the present invention for an intake port injecting type fuel injection system for the gasoline engine. The air introduced through an air cleaner 12 is measured by an air flow meter 11 and subsequently passes through a throttle valve 17 to be introduced into engine cylinders via an intake manifold 18. The control unit 3 calculates a fuel supply amount necessary for combustion on the basis of an air flow rate indicative signal from the air flow meter 11. The fuel in the determined amount is injected into the intake manifold 18 through one or more fuel injection valves 8. To the tip end of the air assisted fuel injection valve, the air for atomization of the fuel is supplied from the downstream of the air flow meter 11 in an air induction system through an air passage 16 and the air pump 2. The air pump 2 is designed to be driven by revolution of the starter motor 1. Since the atomization air is measured by the air flow meter 11, the atomization air will never serve as an error component in calculation of the fuel supply amount. The battery 9 is connected to the starter motor 1 through the switching device 4. By the switching device 4, the electromagnetic actuator 6 is actuated to establish engagement between the pinion gear 10 and the ring gear 7 for cranking of the engine. The switch 4c of the switching device 4 is then closed to supply the power to the starter motor 1. After completion of cranking, the electromagnetic actuator 6 is turned off to release the pinion gear 10 from the ring gear 7. Judgement of starting up of the engine can be made by detecting either one of the engine speed N or a battery voltage increasing across a predetermined value.

In the shown system, the catalytic converter system includes a pre-catalytic converter 15a arranged immediate downstream of an exhaust manifold and a main-catalytic converter 15b arranged beneath a floor panel of a vehicle body. Within the pre-catalytic converter 15a, the resistor 5 to flow the motor current is disposed. The resistor 5 is connected between the battery 9 and the starter motor 1 when the air pump 2 is driven after cranking. By the resistor 5, the excess current is prevented from flowing through the starter motor 1. Therefore, the starter motor 1 is prevented from over heating and shortening of the life. Also, since the precatalytic converter 15a can be heated by the resistor 5, a period required to activate the catalyst can be shortened. In addition, the casing of the pre-catalytic converter 15a can be utilized as a current path to the resistor 5.

Figure 16:
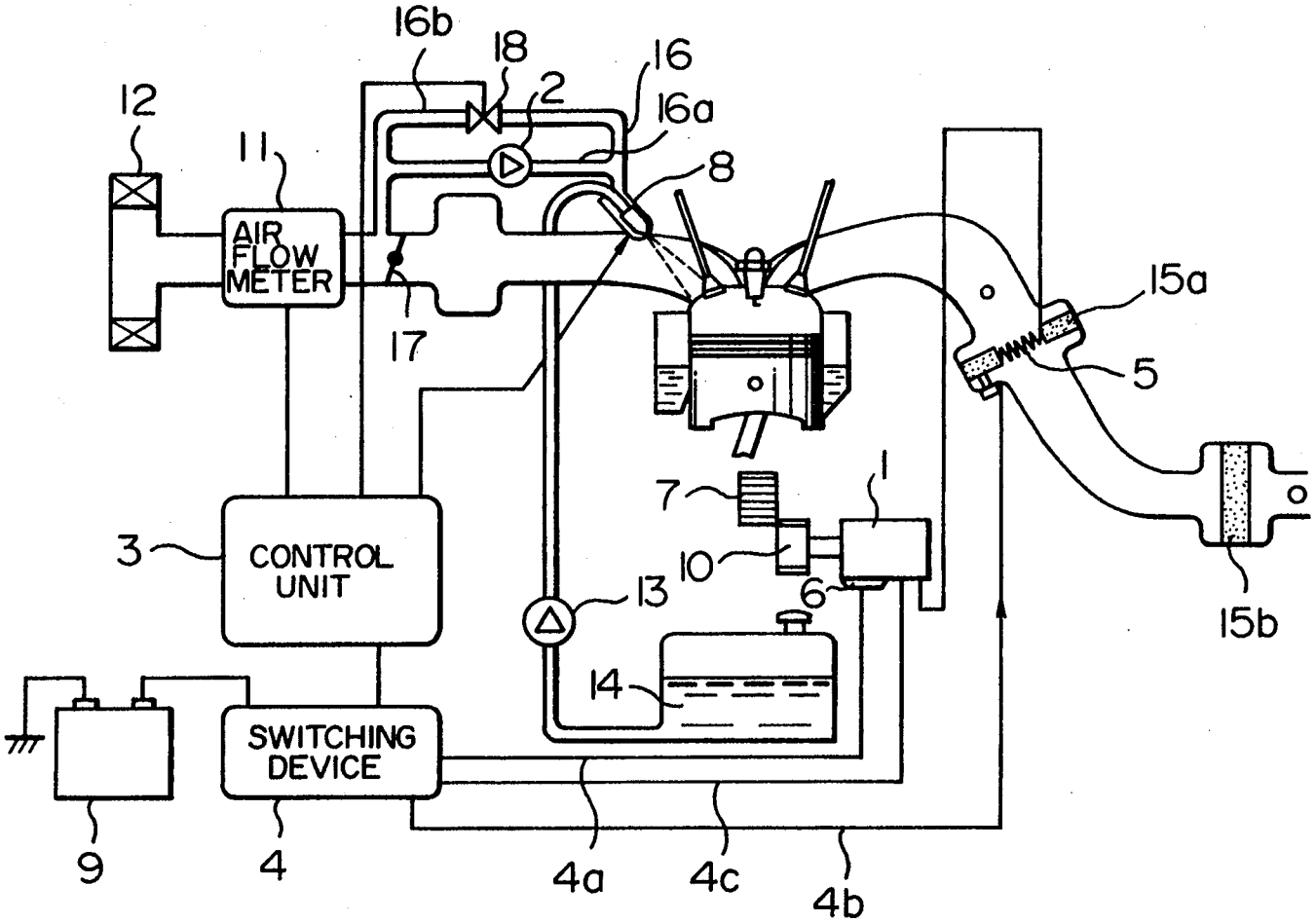
FIG. 16 is a schematic block diagram showing a further embodiment of a control circuit for the starter motor and the air pump.

FIG. 16 shows another example of the application of the present invention for the intake port injection type fuel injection system for the gasoline engine. The shown system is basically the same as the embodiment of FIG. 15. Like reference numerals to FIG. 15 represent like elements. Therefore, discussion will be given only for the construction different from that of FIG. 15. The construction in FIG. 16 different from that of FIG. 15 is that a bypass passage 16b and an air control valve 18 disposed in the bypass passage 16b , are provided in parallel to the air passage 16a, in which the air pump 2 is disposed.

Figure 17:
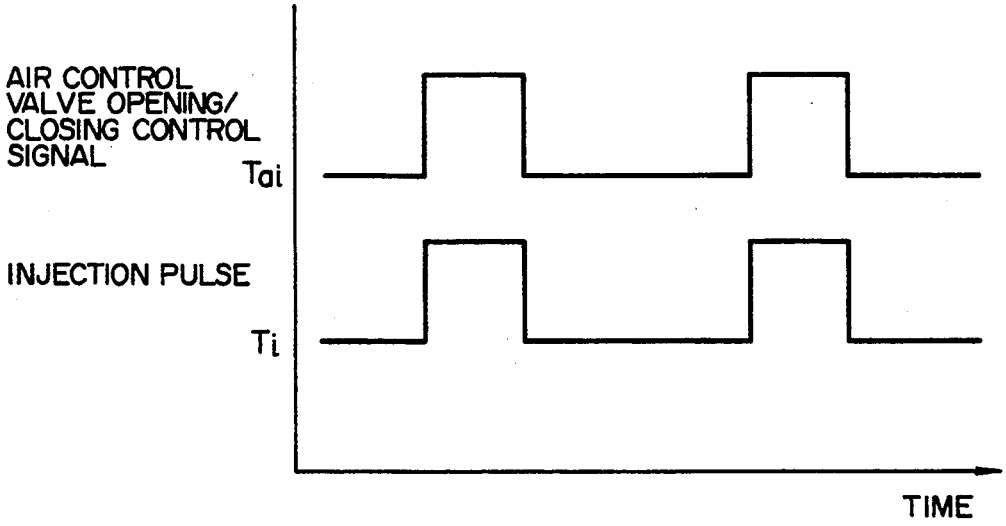
FIG. 17 is a timing chart showing a relationship between a signal for an air control valve and an injection pulse.

When a diaphragm pump is employed as the air pump 2, the air may not flow into the injection valve 8 by the vacuum pressure in the intake manifold while the air pump is held inoperative. Therefore, in such case, the air control valve 18 is opened to flow the air through the bypass passage 16b by the pressure difference between the atmospheric pressure and the vacuum pressure in the intake manifold. When the engine speed is increased by the atomization air during engine idling condition, the air amount is controlled by the air control valve 18. Also, as show in FIG. 17, it is possible to control an air injection pulse width $T_{ai}$ relative to a fuel injection pulse width $T_i$ for synchronization of a fuel injection timing and an air injection timing. The air control valve 18 may be a duty controlled valve, a linear stroke controlled valve or so forth. In case of the linear stroke controlled valve, the air can be continuously supplied to the air assisted fuel injection valve since it permits continuous control of the air amount.

Figure 18:
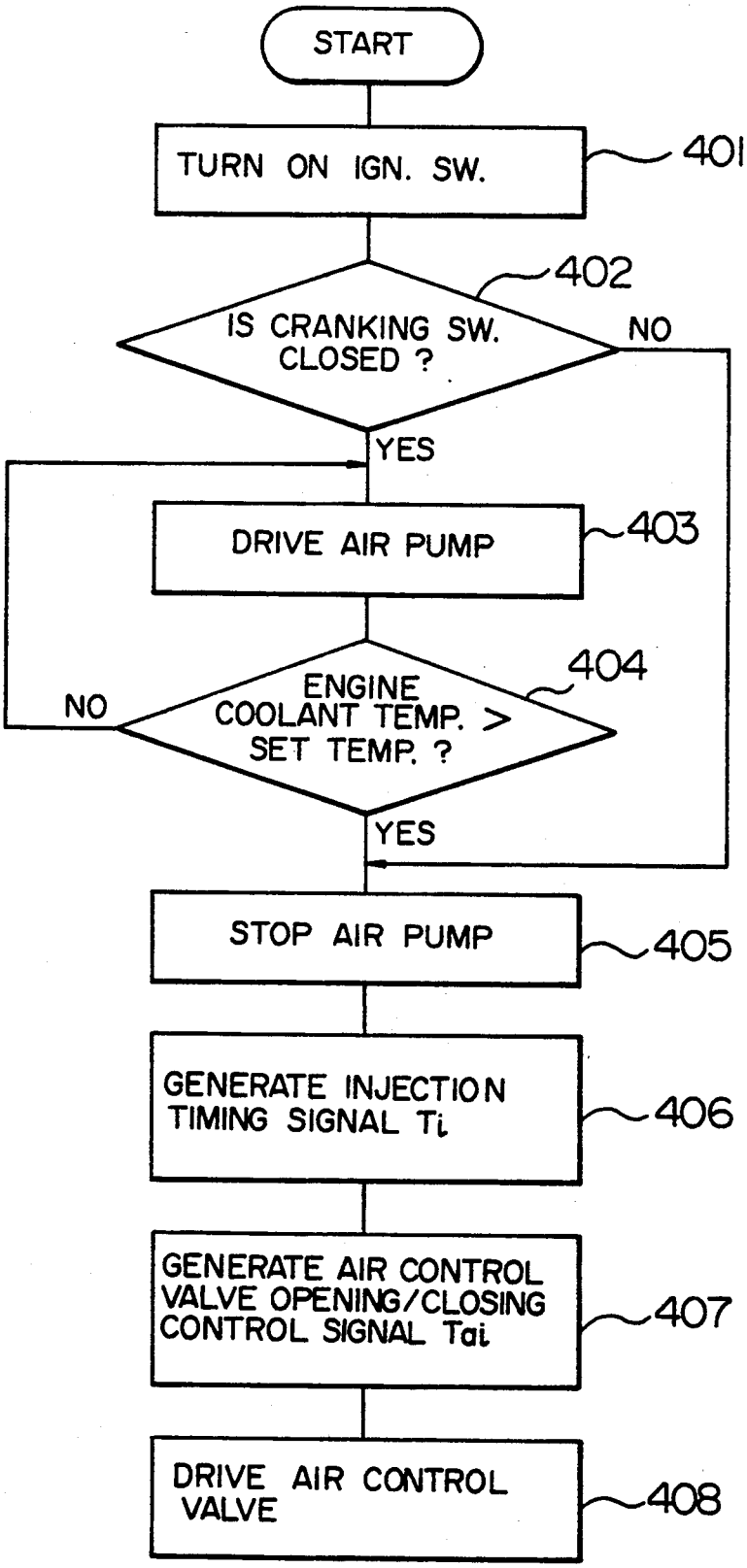
FIG. 18 is a flowchart showing a process of control of the starter motor and the air pump.

Control of the air control valve 18 for opening and closing is performed by the control unit 3. FIG. 18 shows one example of the flowchart of a control process for the air control valve 18. At a step 401, a driver turns an ignition key to turn on an ignition switch. At a step 402, check is performed whether cranking switch 4d is in the closed position. When the cranking switch 4d is in the closed position, the switches of the switching device 4 are controlled to connect the starter motor 1 to the battery 9 and to drive the air pump 2 at a step 403. Then, check is performed whether the engine coolant temperature is higher than or equal to a predetermined set value at a step 404. When the engine coolant temperature higher than or equal to the set value, then, at a step 405, the switches of the switching device 4 are controlled to disconnect the starter motor 1 from the battery 9 to terminate driving of the air pump 2 (and revolution of the starter motor 1). Then, at a step 406, a fuel injection timing signal $T_i$ is generated. The fuel injection timing $T_i$ is generated utilizing appropriate known method. Furthermore, at a step 407, an opening and closing control signal $T_{ai}$ for the air control valve 18 is generated to be synchronous with the fuel injection timing signal $T_i$. Then, at a step 408, the air control valve 18 is driven by the opening and closing control signal $T_{ai}$.

Figure 19:
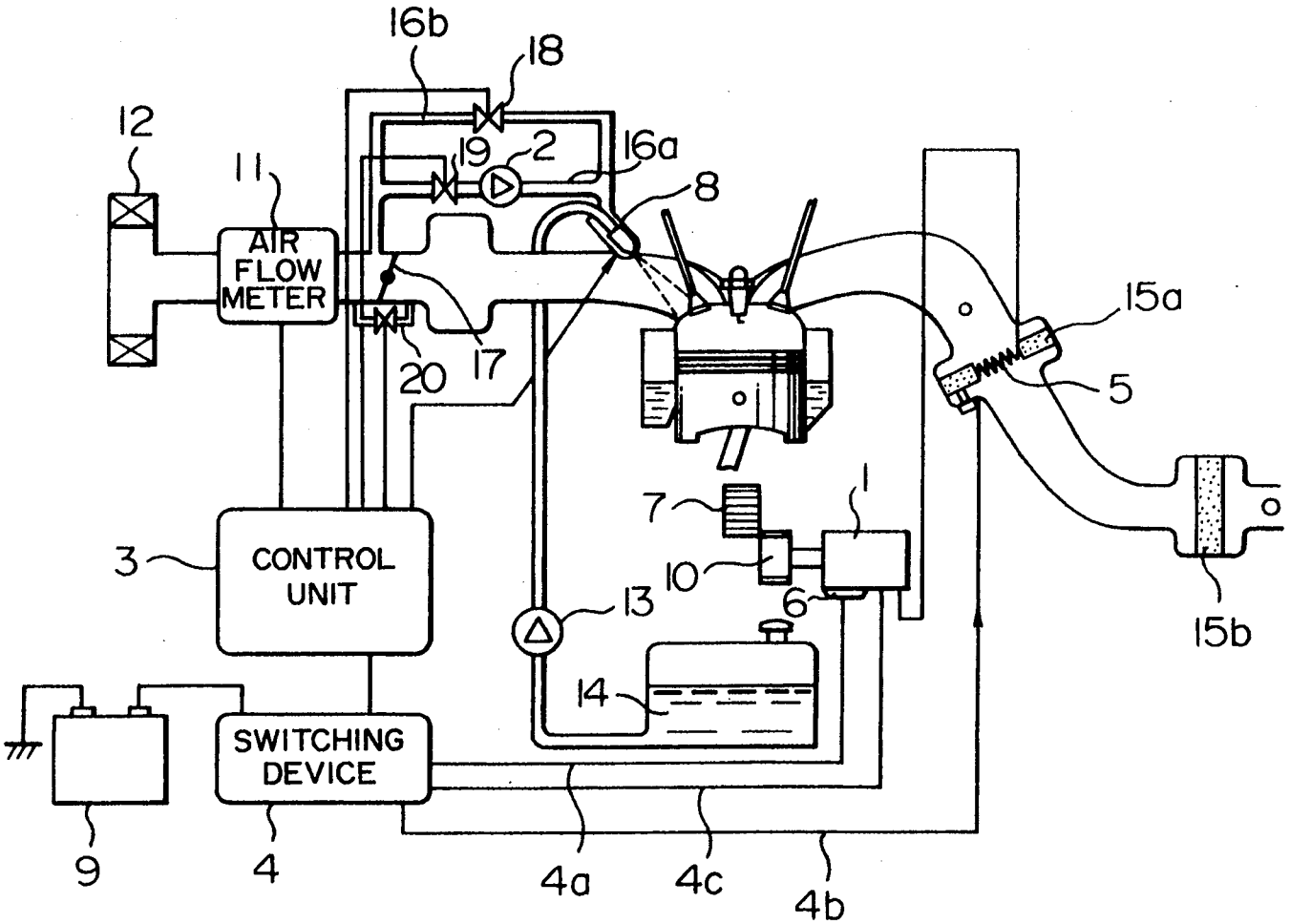
FIG. 19 is a schematic block diagram showing a yet further embodiment of a control circuit for the starter motor and the air pump.

FIG. 19 shows a further example of the application of the present invention for the intake port injection type fuel injection system for the gasoline engine. The shown system is basically the same as the embodiment of FIG. 16. Like reference numerals to FIG. 16 represent like elements. Therefore, discussion will be given only for the construction different from that of FIG. 16. The construction in FIG. 16 different from that of FIG. 15 is that an air control valve 19 is provided in series to the air passage 16a, in which the air pump 2 is disposed. The air control valve 19 permits precise control of the discharge amount of air of the air pump 2 on the basis of the control signal from the control unit 3.

Figure 20:
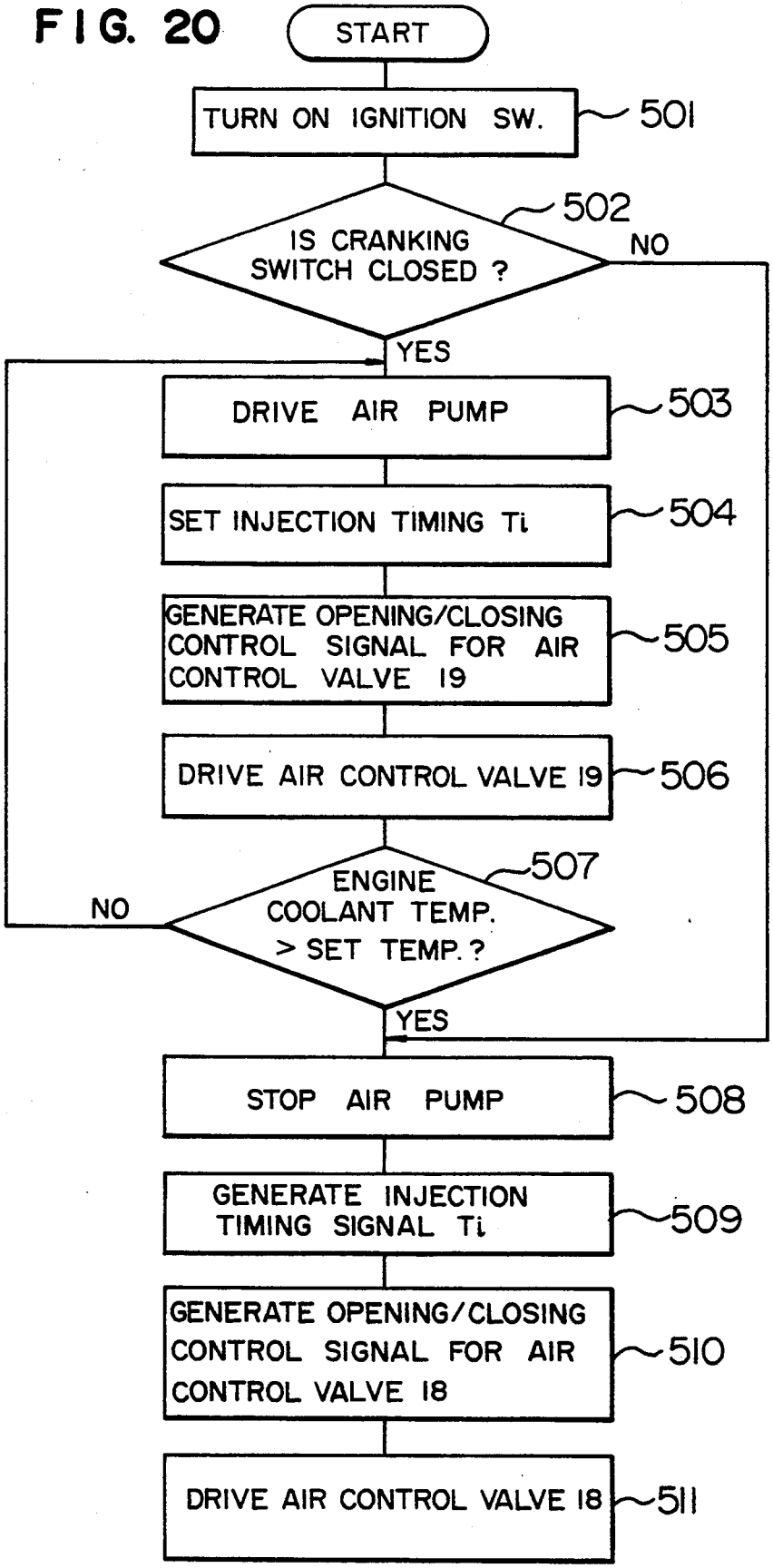
FIG. 20 is a flowchart showing process of control of the starter motor and the air pump.

FIG. 20 shows one example of a control flowchart for the air control valve 19 in the system of FIG. 19. At a step 501, the driver turns an ignition key to turn on the ignition switch. At a step 502, check is performed whether cranking switch 4d is in the closed position. When the cranking switch 4d is in the closed position, the switches of the switching device 4 are controlled to connect the starter motor 1 to the battery 9 and to drive the air pump 2 at a step 503. Then, at a step 504, a fuel injection timing signal $T_i$ is generated. The fuel injection timing $T_i$ is generated utilizing appropriate known method. At a step 505, an opening and closing control signal for the air control valve 19 is generated. At a step 506, the air control valve 19 is driven by the opening and closing control signal which is synchronized with the fuel injection signal. Then, check is performed whether the engine coolant temperature is higher than or equal to a predetermined set value at a step 507. When the engine coolant temperature higher than or equal to the set value, Then, at a step 508, the switches of the switching device 4 are controlled to disconnect the starter motor 1 from the battery 9 to terminate driving of the air pump 2 (and revolution of the starter motor 1). Then, at a step 406, a fuel injection timing signal $T_i$ is generated. The fuel injection timing $T_i$ is generated utilizing appropriate known method. Furthermore, at a step 407, an opening and closing control signal $T_{ai}$ for the air control valve 18 is generated to be synchronous with the fuel injection timing signal $T_i$. Then, at a step 408, the air control valve 18 is driven by the opening and closing control signal $T_{ai}$.

It should be noted that, in FIG. 19, a valve disposed in a bypass passage arranged in parallel to the throttle valve 17 is a idling speed control valve 20. The valve 20 is controlled by a control signal from the control unit 3 to adjust an engine idling speed by adjusting an intake air flow rate during idling.

Figure 21:
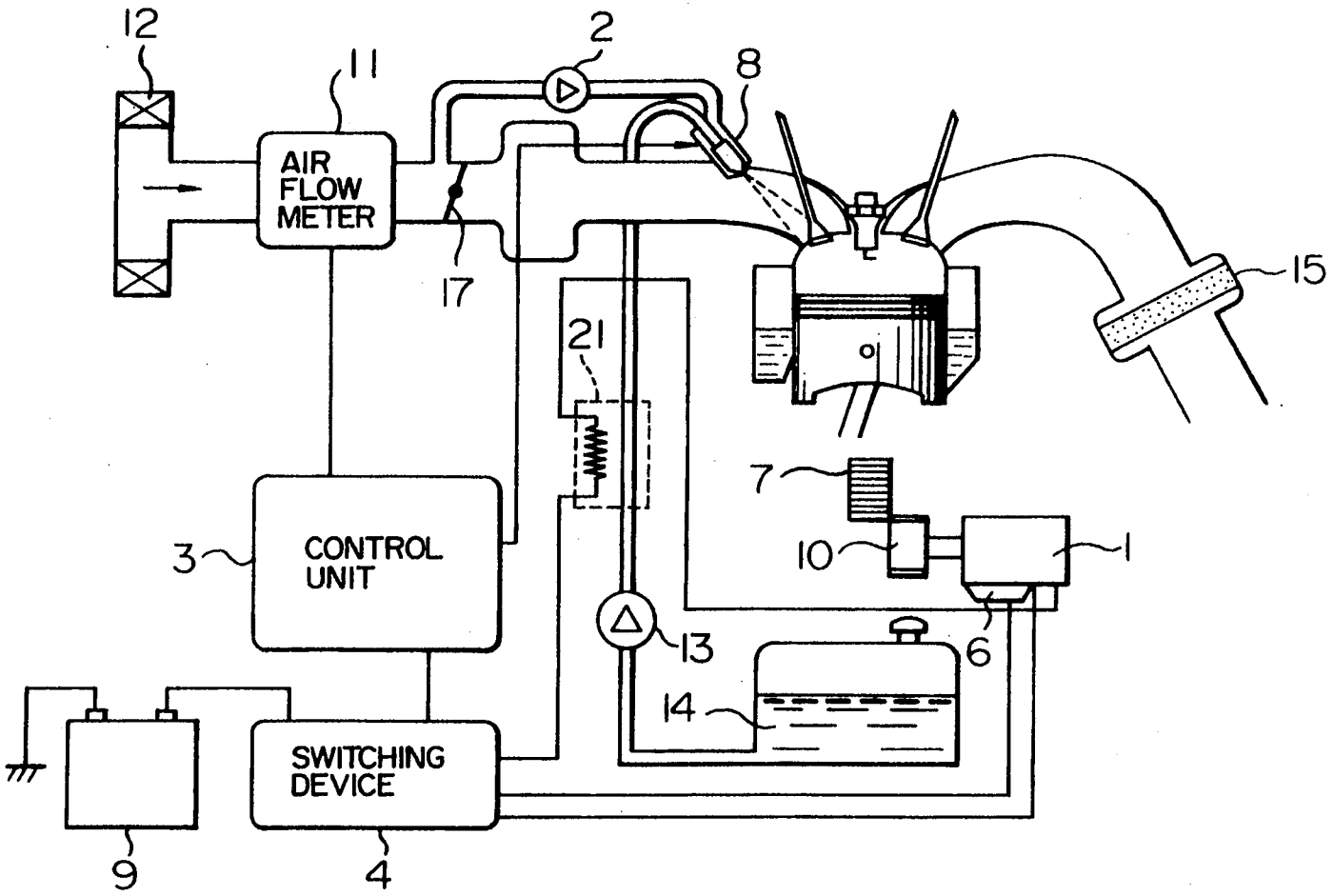
FIG. 21 is a block diagram of a still further embodiment of a control circuit for the starter motor and the air pump.

FIG. 21 shows a still further example of the application of the present invention for the intake port injection type fuel injection system for the gasoline engine. The shown system is basically the same as the embodiment of FIG. 4. Like reference numerals to FIG. 4 represent like elements. Therefore, discussion will be given only for the construction different from that of FIG. 4. The construction in FIG. 21 different from that of FIG. 4 is that a fuel heating resistor 21 is arranged in the vicinity of a fuel pipe in place of the current limiting resistor 5. The fuel heating resistor 21, of course, functions to limit the current for the starter motor, as well as heating of the fuel flowing through the fuel pipe by heat generated in the resistor for contributing vaporization of the injected fuel. By promoting vaporization of the fuel by heating the fuel, generation of hydrocarbon (HC) can be suppressed.

Figure 22:
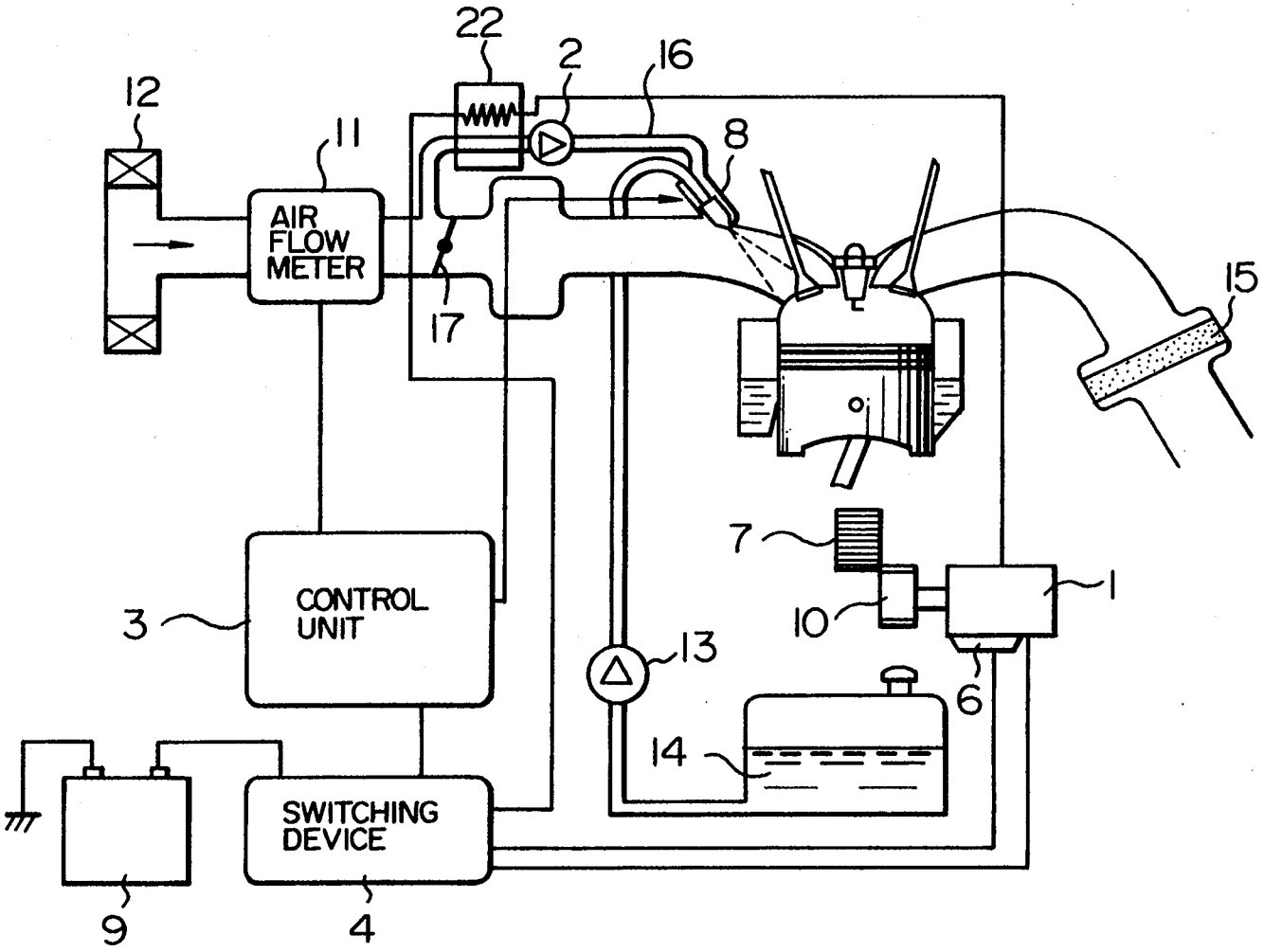
FIG. 22 is a block diagram of a yet further embodiment of a control circuit for the starter motor and the air pump.

FIG. 22 shows a still further example of the application of the present invention for the intake port injection type fuel injection system for the gasoline engine. The shown system is basically the same as the embodiment of FIG. 4. Like reference numerals to FIG. 4 represent like elements. Therefore, discussion will be given only for the construction different from that of FIG. 4. The construction in FIG. 22 different from that of FIG. 4 is that an air heating resistor 22 is arranged in the vicinity of the air passage 16 in place of the current limiting resistor 5. The air heating resistor 22, of course, functions to limit the current for the starter motor 1, as well as heating of the air supplied to the injection valve by the heat of the resistor for contributing vaporization of the injected fuel. By promoting vaporization of the fuel by heating the fuel, generation of the hydrocarbon can be suppressed.

Figure 23:
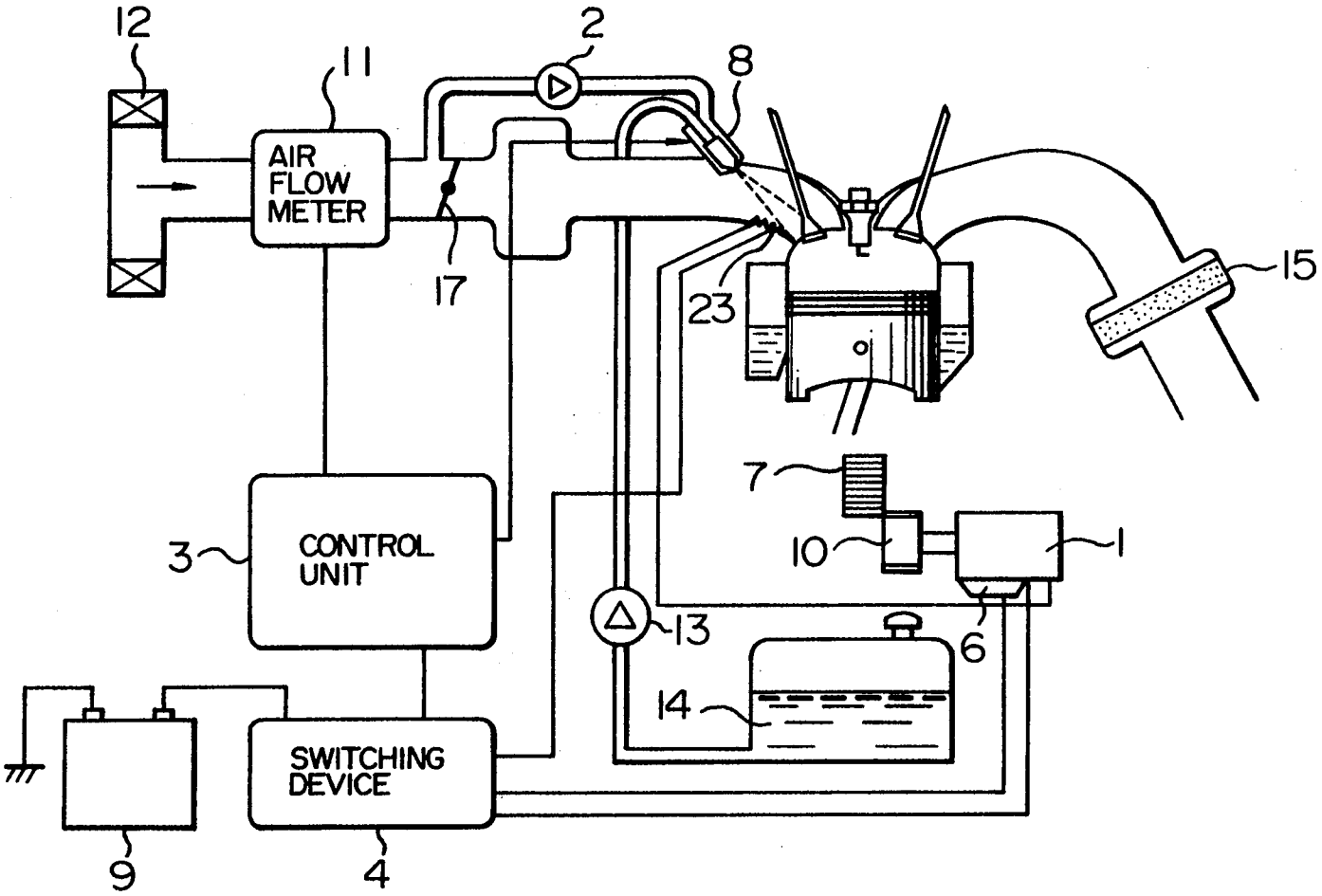
FIG. 23 is a block diagram of a further embodiment of a control circuit for the starter motor and the air pump.

FIG. 23 shows a still further example of the application of the present invention for the intake port injection type fuel injection system for the gasoline engine. The shown system is basically the same as the embodiment of FIG. 4. Like reference numerals to FIG. 4 represent like elements. Therefore, discussion will be given only for the construction different from that of FIG. 4. The construction in FIG. 23 different from that of FIG. 4 is that a port heating resistor 23 is arranged around the intake port in place of the current limiting resistor 5. The port heating resistor 23 of course serves to limit the current for the starter motor, and, as well to heat a mixture passing through the intake port by the heat of the resistor to contribute for vaporization of the injected fuel. By promoting vaporization of the fuel, generation of the hydrocarbon can be suppressed. The resistor 23 is preferably a plane type heating resistor, and can be PTC heater for example.

Figure 24:
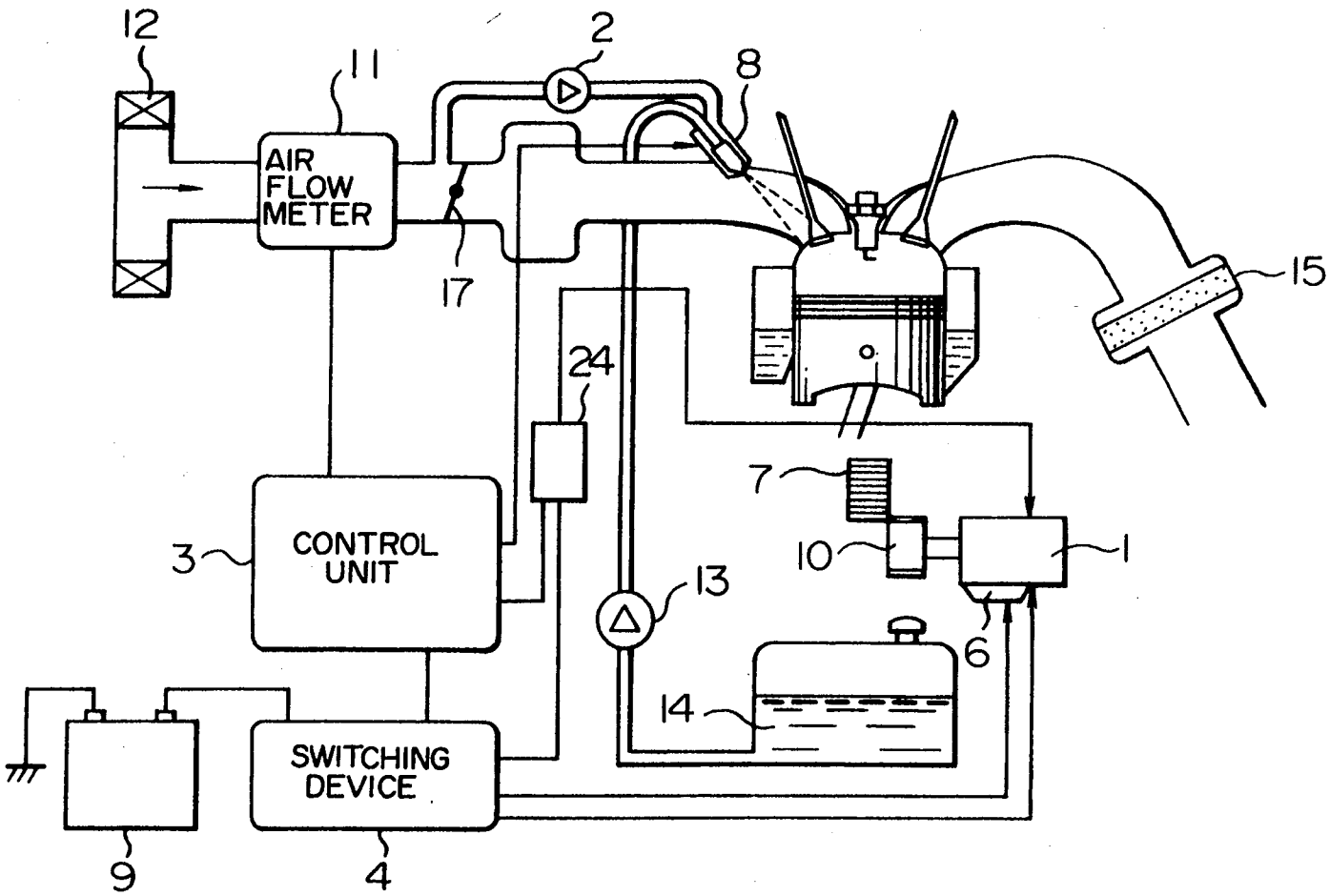
FIG. 24 is a block diagram of a still further embodiment of a control circuit for the starter motor and the air pump.
Figure 25:
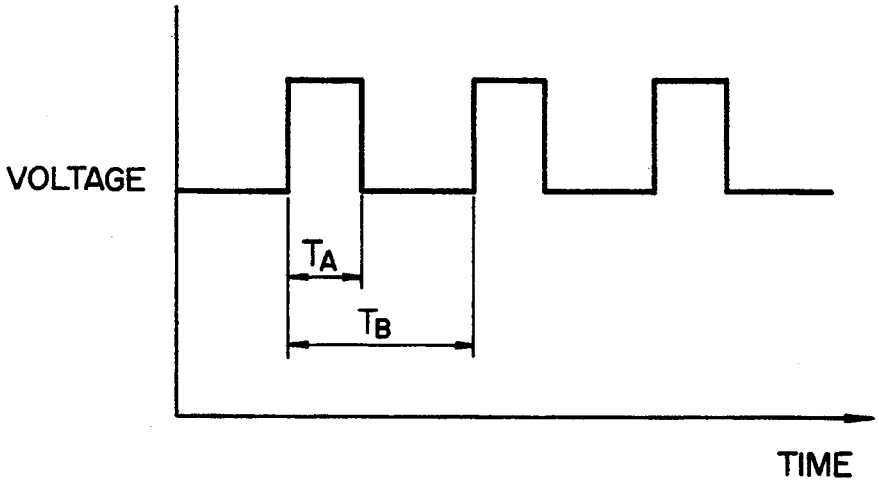
FIG. 25 is a timing chart showing a process of control for a chopper circuit.
Figure 26:
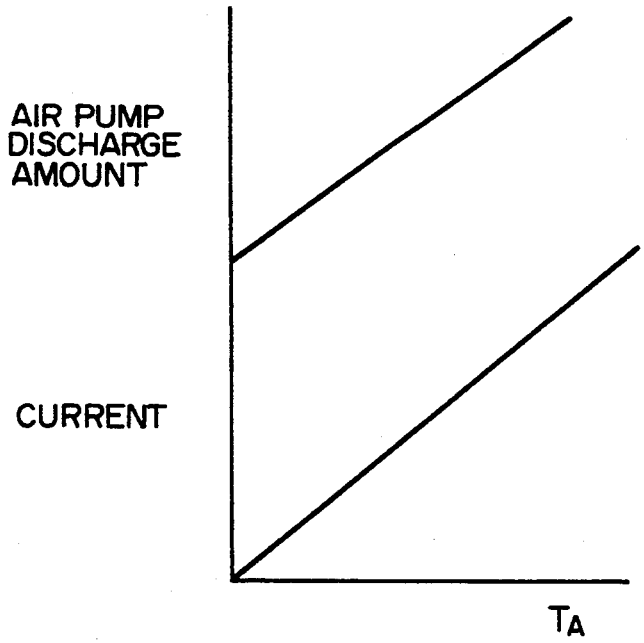
FIG. 26 is a graph showing relationship between a chopper output and a displacement of the air pump.

FIG. 24 shows a still further example of the application of the present invention for the intake port injection type fuel injection system for the gasoline engine. The shown system is basically the same as the embodiment of FIG. 4. Like reference numerals to FIG. 4 represent like elements. Therefore, discussion will be given only for the construction different from that of FIG. 4. The construction in FIG. 24 different from that of FIG. 4 is that a chopper circuit 24 is interposed between the switching device 4 and the starter motor 1 in place of the current limiting resistor 5. The chopper circuit 21 has a function to perform chopping control of the battery voltage to control the current for the starter motor 1. As shown in FIG. 25, the chopper circuit 24 controls an effective current value for the starter motor 1 by adjusting a duty ratio of a conduction period TA and a blocking period TB of the battery voltage. Adjustment of the duty ratio can be achieved by a command from the control unit 3. The advantage of the shown embodiment is a capability of avoidance of power loss by the resistor and overheating of the resistor. In addition, by controlling the conduction period TA for the starter motor 1 by the chopper circuit 24 as shown in FIG. 26, the air discharge amount of the air pump 2 can be adjusted by adjusting a revolution speed of the starter motor 1. In such case, the conduction period TA can be adjusted depending upon the engine operating condition.

Figure 27:
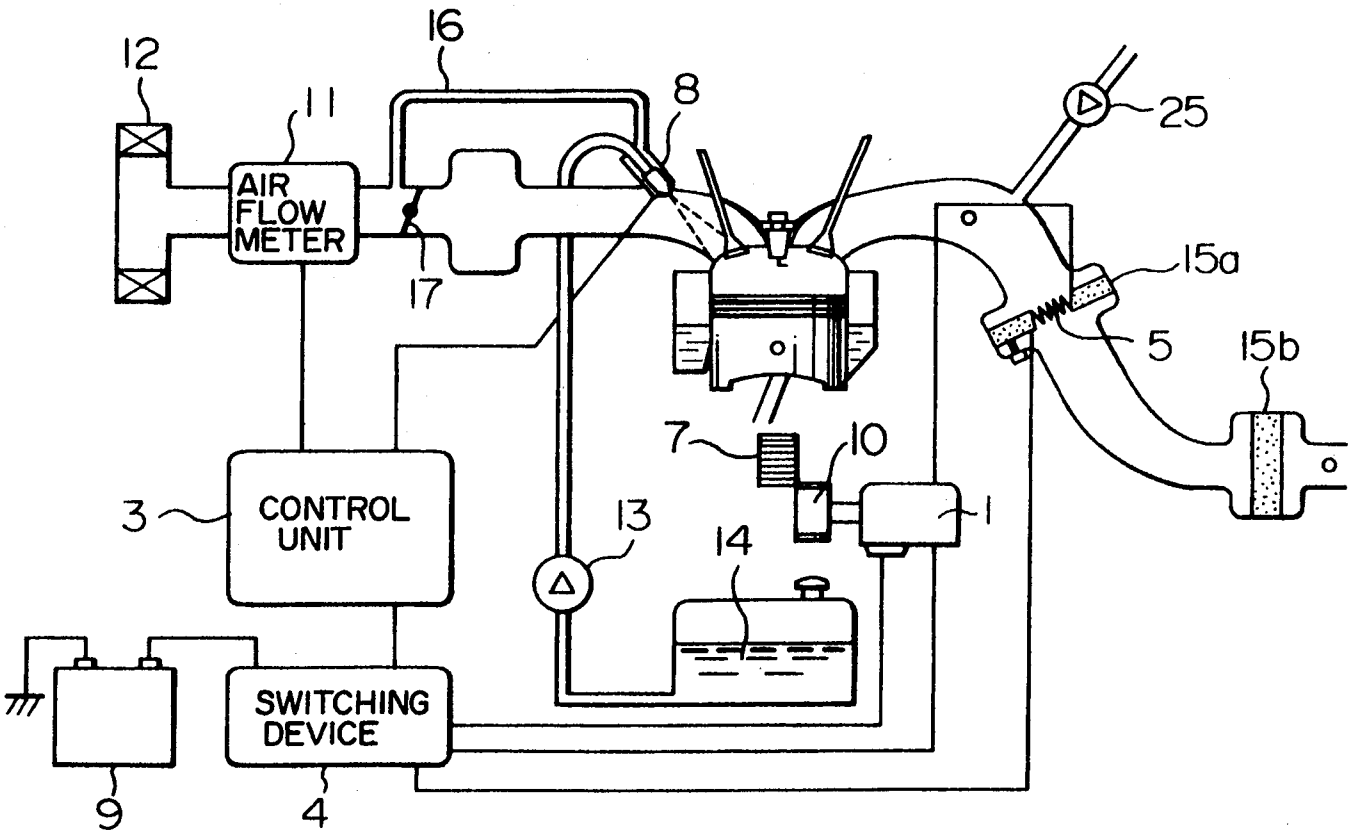
FIG. 27 is a block diagram of a still further embodiment of a control circuit for the starter motor and the air pump.

FIG. 27 shows a still further example of the application of the present invention for the intake port injection type fuel injection system for the gasoline engine. The shown system is basically the same as the embodiment of FIG. 15. Like reference numerals to FIG. 15 represent like elements. Therefore, discussion will be given only for the construction different from that of FIG. 15. The construction in FIG. 27 different from that of FIG. 15 is that the air pump 2 is omitted from the air passage 16, and, in place, an air pump 25 is arranged at immediately upstream of the pre-catalytic converter **15*a* for discharging a secondary air. The secondary air from the air pump 25 contributes for combustion of the hydrocarbon contained in the exhaust gas in the catalytic converters 15*a* and 15*b*. The air pump 25 is driven until activation of the catalysts. Methods for driving and controlling the air pump 25 is basically the same as that for the air pump 2**. Therefore, discussion therefor is neglected.

Figure 28:
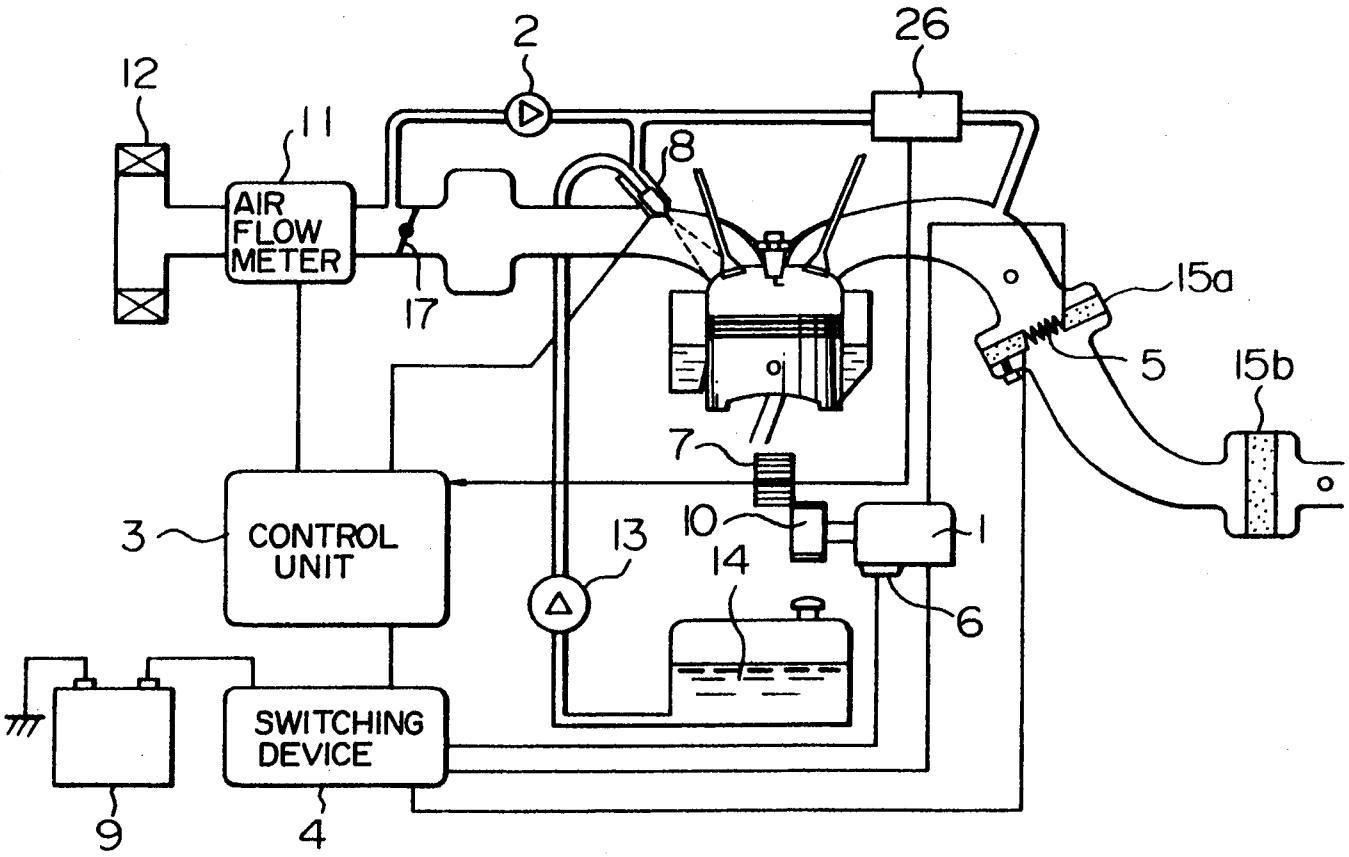
FIG. 28 is a block diagram of a yet further embodiment of a control circuit for the starter motor and the air pump.

FIG. 28 shows a further modified application of FIG. 27. The like reference numerals to FIG. 27 represent like elements. Accordingly, discussion will be given only for the construction different from that in FIG. 27. The construction in FIG. 28 differentiated from FIG. 27 is that the air pump 2 is provided and the discharge outlet of the air pump is branched to a passage for supplying air to the air assisted fuel injection valve 8 and to a passage for supplying the secondary air for the catalyst.

Figure 29:
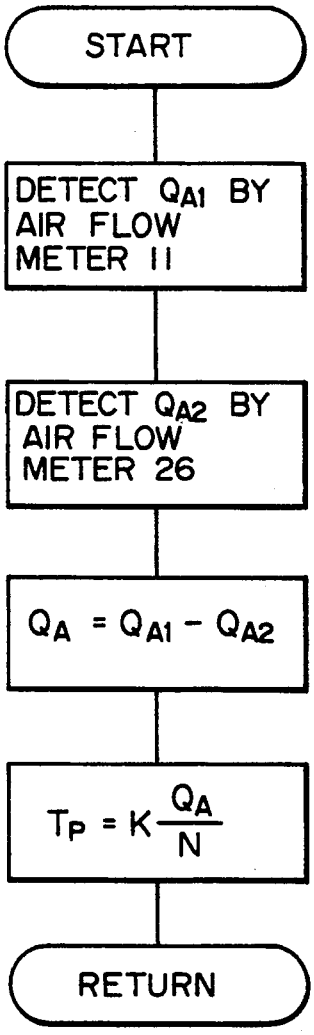
FIG. 29 is a flowchart showing a process for determining an injection amount.

At this time, the secondary air flow rate for the exhaust system is measured by an air flow meter 26. As shown in FIG. 29, by subtracting the air flow rate indicative signal $Q_{A2}$ of the air flow meter 26 from the air flow rate indicative signal $Q_{A1}$ of the air flow meter 11, an intake air flow rate $Q_A$ actually introduced into the engine cylinder is derived thereby to calculate a basic fuel injection amount $T_p$ according to equation (1) mentioned later.

Figure 30:
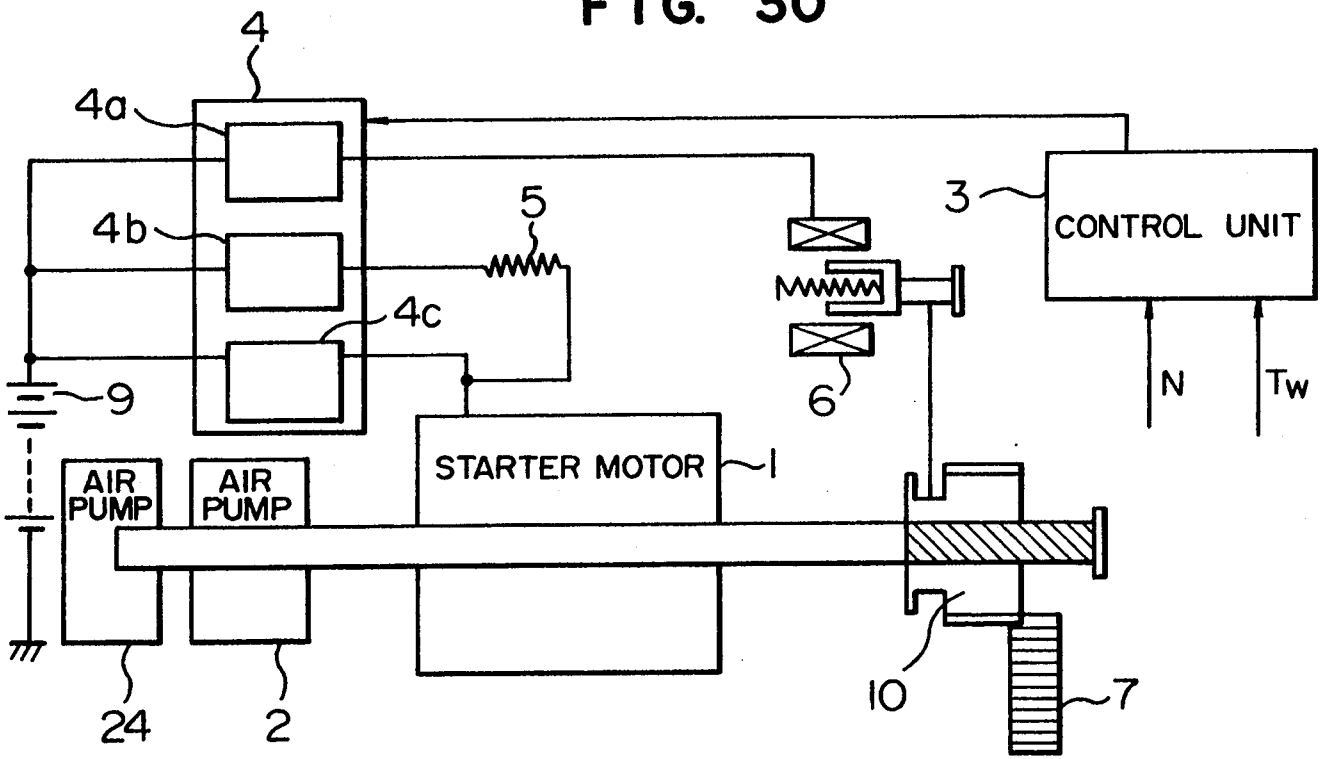
FIG. 30 is a block diagram of a still further embodiment of a control circuit for the starter motor and the air pump.
Figure 31:
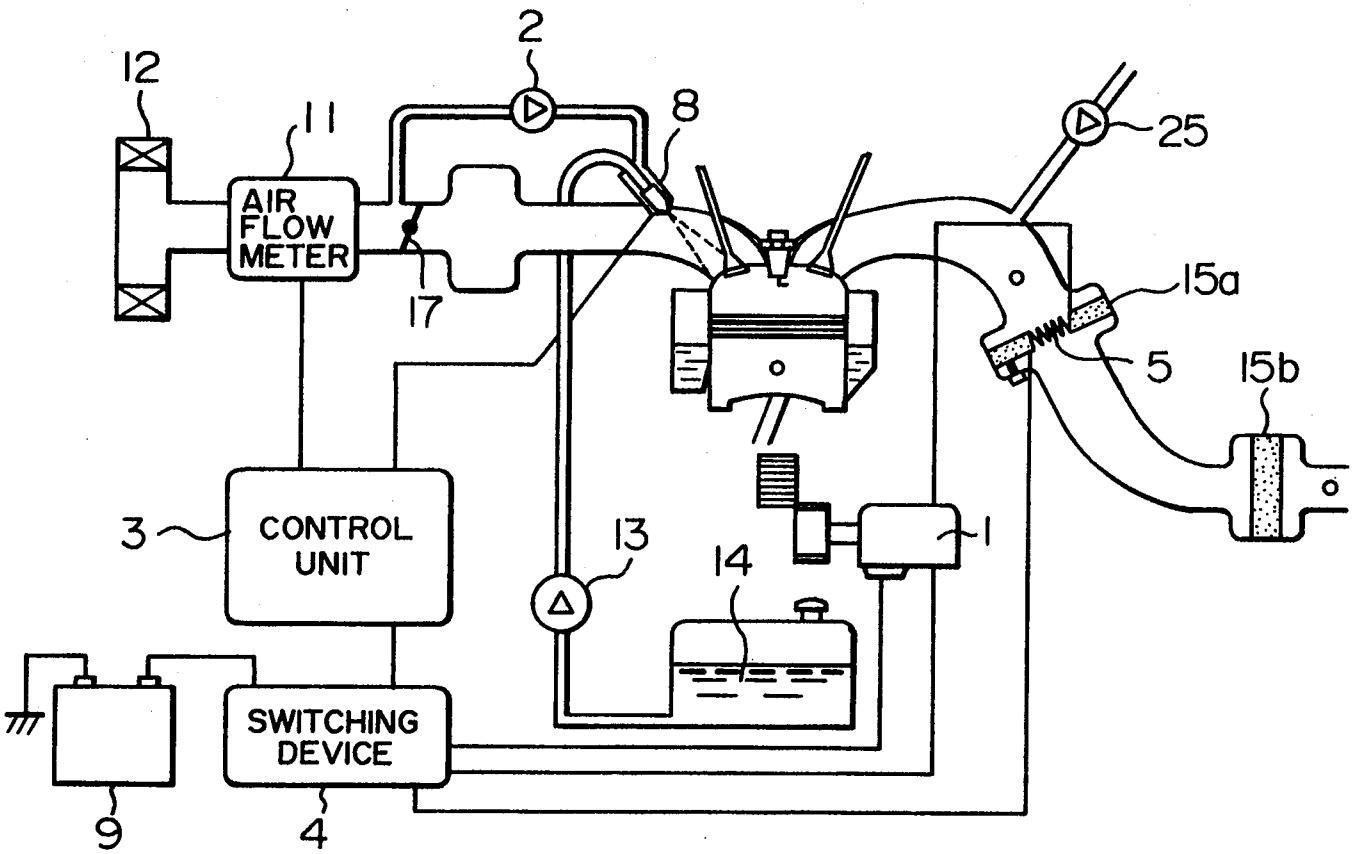
FIG. 31 is a block diagram of a yet further embodiment of a control circuit for the starter motor and the air pump.

FIG. 30 shows one embodiment of the present invention. The air pump 2 for the air assisted fuel injection valve and the air pump 25 for the exhaust secondary air are driven simultaneously by the starter motor 1. In such construction, since the atomization air and the exhaust secondary air can be controlled independently of each other as shown in FIG. 31, the air pressures and the pump capacities can be arbitrary selected.

Figure 32:
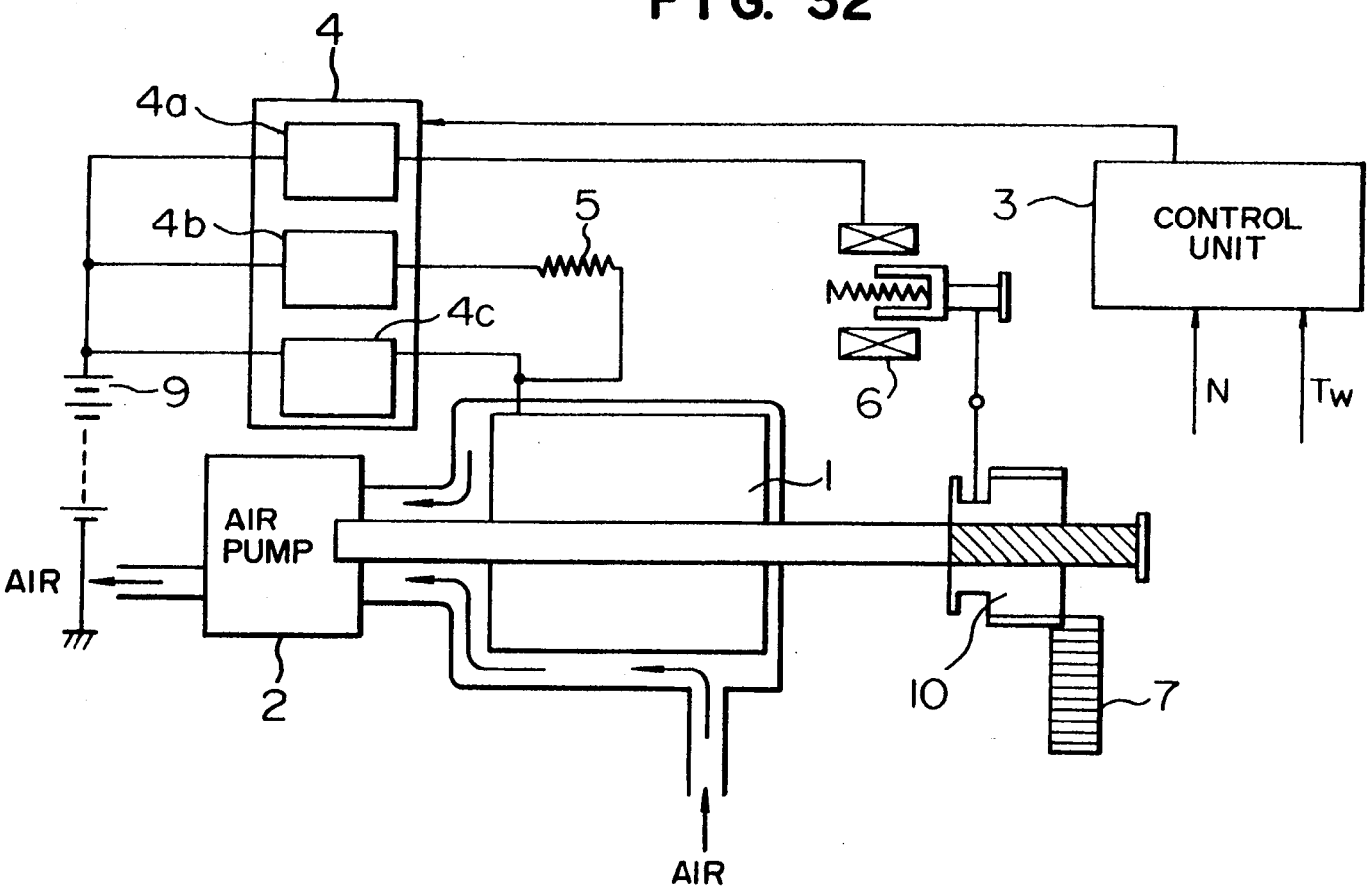
FIG. 32 is a block diagram of a yet further embodiment of a control circuit for the starter motor and the air pump.

FIG. 32 shows another embodiment of the present invention. The air around the starter motor 1 is drawn and supplied to the air pump 2. The starter motor 2 is heated by the motor current during revolution. In the shown construction, the starter motor 1 can be cooled by the air flow toward the air pump 2. The shown construction is, in turn, effective for heating the atomization air.

Figure 33:
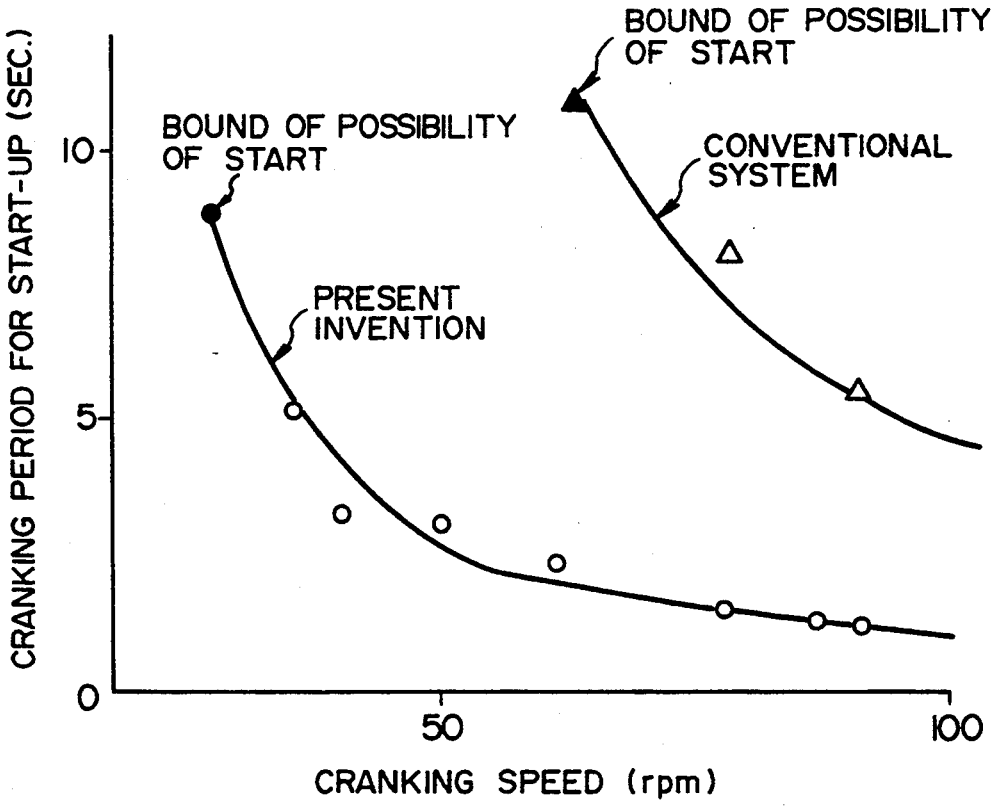
FIG. 33 is a comparative chart showing effect for an engine start-up characteristics in the prior art and the present invention.

FIG. 33 shows one example of an effect of the invention. In comparison with the conventional systems, since the present invention can introduce the air into the air assisted fuel injection valve 8 even upon cranking, it becomes possible to start-up the engine at low cranking speed. By this, it becomes possible to make the starter motor compact and light weight to permit improvement of the engine start-up characteristics without causing increasing of the weight of the overall system.

Figure 34:
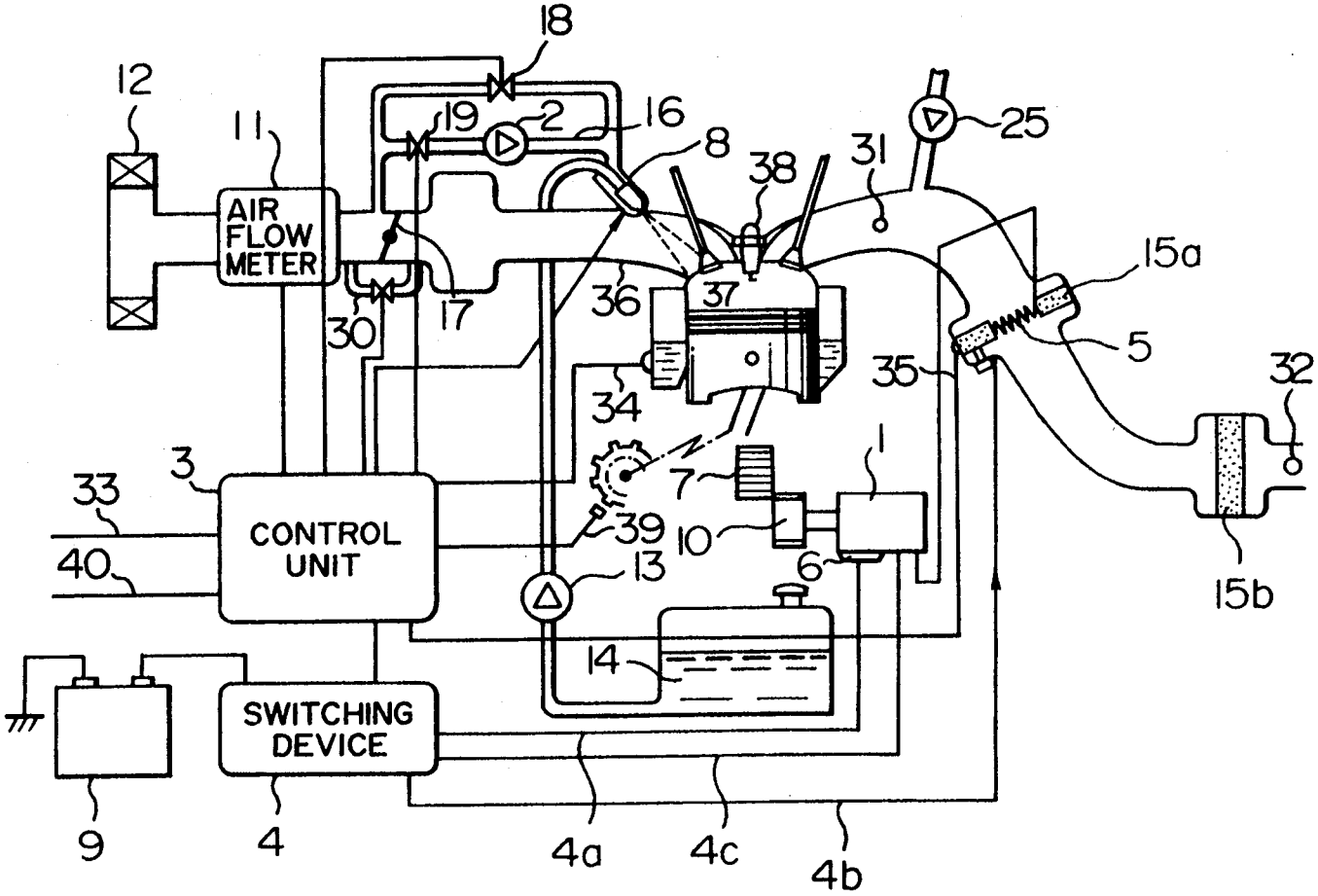
FIG. 34 is a block diagram of a still further embodiment of a control circuit for the starter motor and the air pump.

FIG. 34 shows a further embodiment of the present invention. The air is introduced through the air cleaner 12, measured by the air flow meter 11 and introduced into the engine cylinder 37 through the intake manifold 36. The fuel is sucked from the fuel tank 14 and pressurized by the fuel pump 13 and then intermittently injected into the intake port through the air assisted fuel injection valve 8. In view of response and air/fuel ratio control performance, it is desirable to employ a sequential injection for performing fuel injection for each engine cylinder every two revolutions. However, it is possible to employ a single point injection to inject fuel for all cylinders per every revolution. The air flow rate indicative signal of the air flow meter 11 and crank angle signals, i.e. crank reference signals and/or crank position signals, are inputted to the control unit 3 for calculation of the basic fuel injection amount Tp (valve open timing of the injection valve) and the actual fuel injection amount $T_i$ through the following equations.

$$T_p = K\frac{Q_A}{N}(1 + K_1 + K_2 + \ldots + K_n) \quad (1)$$

$$T_i = T_p \times (1 + \alpha) \quad (2)$$

wherein $T_i$ is fuel injection pulse width; N is engine speed; $Q_A$ is the air flow rate indicative signal (engine load); K is constant; and $K_1 \sim K_n$ are correction coefficients; and a is a compensation factor of an airfuel ratio sensor.

The correction coefficient $K_1$ is varied according to the output signal of the coolant temperature sensor 34. When the coolant temperature is low, the value of $T_i$ is made large, and the air-fuel ratio is made small (enriched mixture). The feed-back control of the fuel injection amount is made by varying the compensation factor $\alpha$ according to the output of the air-fuel ratio sensor 31. By utilizing of the outputs from the air-fuel ratio sensors 31 and 32 disposed before and after the catalytic converters 15*a* and 15*b*, deterioration of the catalytic converters 15*a* and 15*b* can be monitored.

The atomization air is led to the tip end of the air assisted fuel injection valve 8 and collided with the fuel for atomizing the fuel and thus promoting vaporization of the fuel. The atomization air is introduced from the position upstream of the throttle valve 17 to the air assisted fuel injection valve 8 through the air control valve 18. Normally, in the engine operating condition where the open angle of the throttle valve 17 is small, the pressure within the intake manifold 36 is lower than the atmospheric pressure. Therefore, the air flows depending upon the pressure difference. The atomization air can be arbitrarily adjusted in amount depending upon the engine operating condition by means of the air control valve 18. For example, when the idling speed is desired to be lowered, the open degree of the air control valve is reduced. Another valve (idling speed control valve: ISCV) 30 is provided for adjusting the idling speed. In order to avoid overrunning of the idling speed, a total open area of the air control valve 18 and the ISCV 30 is controlled to be maximum value of a set idling speed. Therefore, in order to maximize the effect of the atomization air, the air control valve 18 is initially opened and the ISCV 30 is opened subsequently. In FIG. 34, the reference numerals 31 and 32 indicate air-fuel ratio sensors, 34 indicates a coolant temperature sensor, and 38 indicates an ignition plug.

Figure 35:
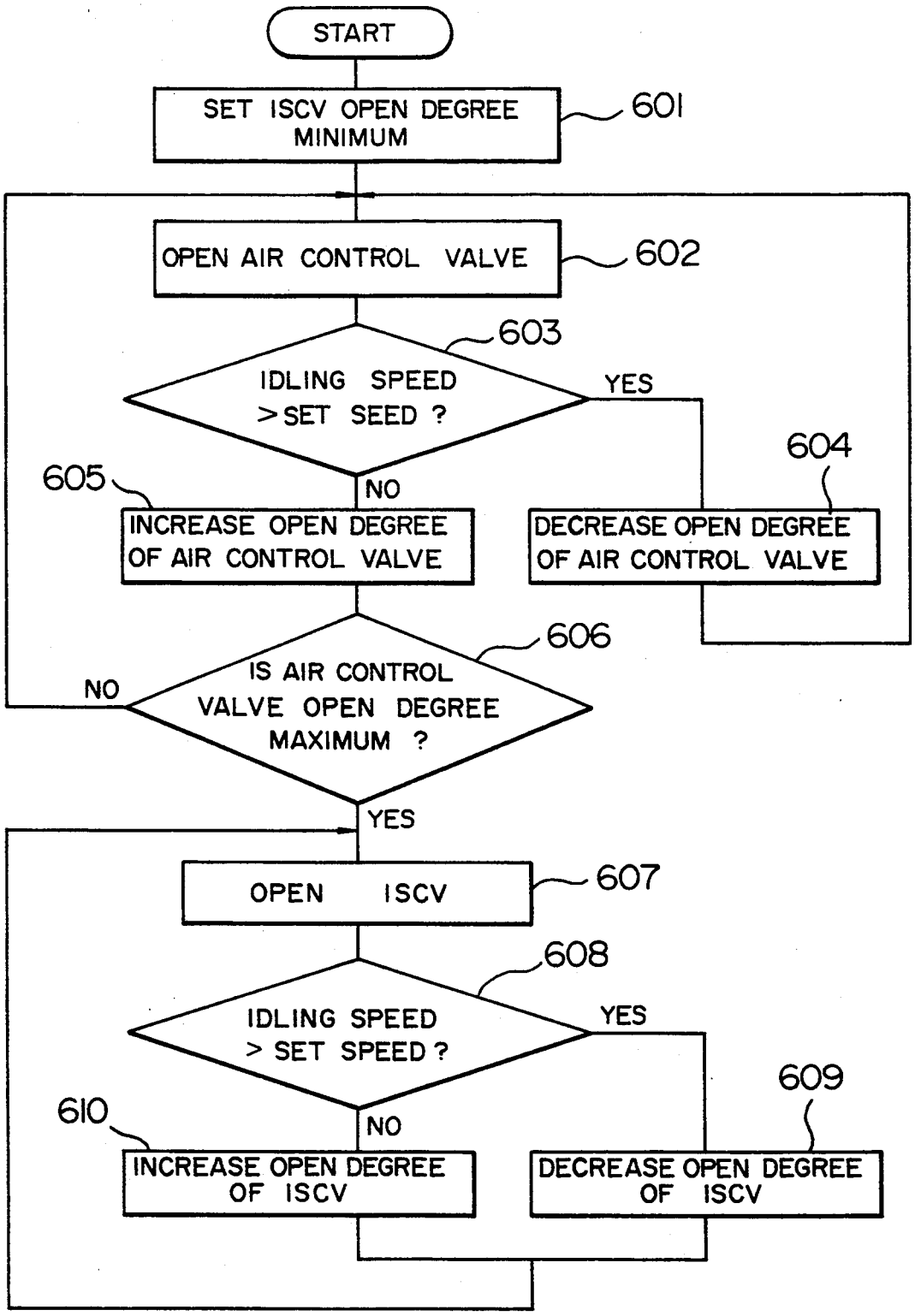
FIG. 35 is a flowchart showing a process of control of the starter motor and the air pump.

FIG. 35 shows a flowchart of a process for controlling the air control valve 18 and the ISCV 30 of FIG. 34. The control unit 3 controls the air control valve and the ISCV 30 according to the shown flowchart.

At a step 601, the open degree of the ISCV 30 is set at a minimum value. At a step 602, the air control valve 18 is operated to open. At a step 603, the engine idling speed is derived on the basis of the output of the crank angle sensor 39. Then, judgement is made whether the derived idling speed is higher than or lower than a set speed. If the idling speed is higher than the set speed, the open degree of the air control valve 18 is adjusted to be smaller. Thereafter, the process returns to the step 602. On the other hand, when the idling speed is lower than the set speed, the open degree of the air control valve 18 is adjusted to be larger, at a step 605. At a step 606, the open degree of the air control valve 18 is checked whether it is the maximum open degree. If not the maximum open degree, the process returns to the step 602.

On the other hand, when the open degree of the air control valve 18 already reaches the maximum open degree, the ISCV 30 is operated to increase the open degree for a given magnitude from the minimum open degree at a step 607. Then, the idling speed is checked again whether it is higher than or lower than the set speed, at a step 608. If the idling speed is higher than the set speed, the open degree of the ISCV 30 is adjusted to be smaller for a given magnitude at a step 609. Then, the process returns to the step 607. On the other hand, when the idling speed is lower than the set speed, the open degree of the ISCV 30 is further increased for the given magnitude, at a step 610. Thereafter, the process returns to the step 607. Through the process of the steps 601 ~610, the engine idling speed can be maintained at the set speed.

Upon engine starting up or in the engine operating condition where the throttle valve is substantially positioned at fully open position, the pressure within the intake manifold becomes approximately equal to the atmospheric pressure. Therefore, at such engine operating conditions, it becomes not possible to assure supply of the atomization air. Therefore, the air pump 2 is provided in the air passage 16 for assuring supply of the atomization air. In order to avoid accumulation of foreign matter in the orifice of the air assisted fuel injection valve 8, it is preferred to employ an oilless type pump, such as the diaphragm pump as the air pump. As set out above, the air pump 2 is driven by the starter motor 1. Upon cranking, by driving the air pump by means of the starter motor, supply of the atomization air can be assured. It is desirable to preliminarily drive the air pump by the starter motor for further assuring supply of the atomization air in advance of cranking and to pressurize the air in the extent of 0.2~1.0 kg/cm$^2$. For example, by providing a door open degree sensor 33 or a seat pressure sensor 40, upon detecting of door opening or seating of the driver, the air pump 2 may be driven in advance of cranking. By this, the air supply can be certainly performed in advance of cranking. In addition, if the fuel is injected under cold engine condition before the atomization air supply is assured, the liquid state fuel may adhere on the a spark ignition plug to cause foul or shorted condition to make engine starting up impossible. To avoid this, the fuel injection may be controlled to initiate injection of the fuel when the air pressure becomes higher than or equal to a predetermined pressure. Satisfaction of atomization air condition may be detected by detecting the elapsed time after starting driving of the air pump 2 exceeding a given period, or by directly measuring the atomization air pressure by means of an air pressure sensor.

Furthermore, in order to quickly rise the air pressure in advance of cranking, the starter motor 1 is driven at an increased speed before establishment of engagement between the pinion gear 10 and the ring gear 7 to drive the air pump at the increased pump speed. When the air pressure reaches the predetermined pressure level and the pinion gear 10 is engaged with the ring gear 7 for initiation of cranking, the revolution speed of the starter motor 1 is lowered to reduce stress upon meshing and thus to avoid damaging or breakage of the gears.

When releasing of the engagement between the pinion gear and the ring gear after completion of cranking and the starter motor is attempted to re-drive due to stalling of engine or so forth, failure of establishing of engagement between the pinion gear and the ring gear can be caused since the starter motor 1 continues revolution due to inertia force of the air pump 2. This may cause damaging or breakage of the gears in the worse case. In such occasion, when the engine stalling condition is detected based on the crank angle signal from the crank angle sensor or a signal from an alternator, the operation for establishing engagement between the pinon gear and the ring gear can be disabled until the crank shaft rotation speed and starter motor speed becomes lower than or equal to a predetermined speed. In the alternative, it is possible to disable engagement of the pinion gear and the ring gear for a predetermined period of time.

During engine cranking state, the cranking speed is significantly fluctuated due to a load in the compression stroke or so forth. Then, the rotation speed of the air pump 2 is significantly fluctuated to cause variation of the discharge amount of the air. Therefore, pulsatile air flow in synchronism with engine strokes can be obtained. When the fuel injection is performed at a timing synchronous with the air pulsation, the fuel can be effectively atomized with Smaller amount of air. That is, if the fuel is injected purely in synchronism with the suction stroke while the air is continuously supplied, the atomization air should be supplied even while the fuel is absent for wasting the air. Furthermore, the atomization air continuously supplied may disturb the fuel accumulated around the intake valve to increase the amount of fuel adhering on the peripheral wall of the intake manifold. Also, due to increasing of the air amount, the greater capacity is required for the air pump and difficulty is encountered in control of the air/fuel ratio. By utilizing the pulsatile flow of the air, these problems can be solved.

By introducing the atomization air to the air assisted fuel injection valve 8 from the portion around the starter motor 1, it becomes possible to cool the starter motor and to heat the air. By heating of the air, the fuel atomization efficiency can be further enhanced.

During a period for warming up the catalyst 15 after cranking, the air pump 2 is maintained to be driven by the starter motor 1. At this time, because of absence of the cranking load, the power to be applied to the starter motor is reduced by means of a resistor or by chopper control with a power element. For instance, by routing the power through a catalyst heating resistor, the power can be effectively utilized.

When the catalyst becomes active and the engine coolant temperature is risen in the extent that satisfactory fuel atomization and an exhaust gas purification can be achieved without driving the air pump, driving of the air pump 2 is terminated. At this time, if the air pump 2 is abruptly stopped, the air amount can be abruptly reduced to possibly cause engine stalling at the idling state or so forth. In such case, with gradually decreasing the pump speed, the open degrees of the air control valve 18 and the ISCV 30 are increased. In the alternative, the air flow amount may be controlled by means of the air control valve 19 provided at the position upstream or downstream of the air pump, while the air discharge amount of the air pump is gradually reduced.

Figure 36:
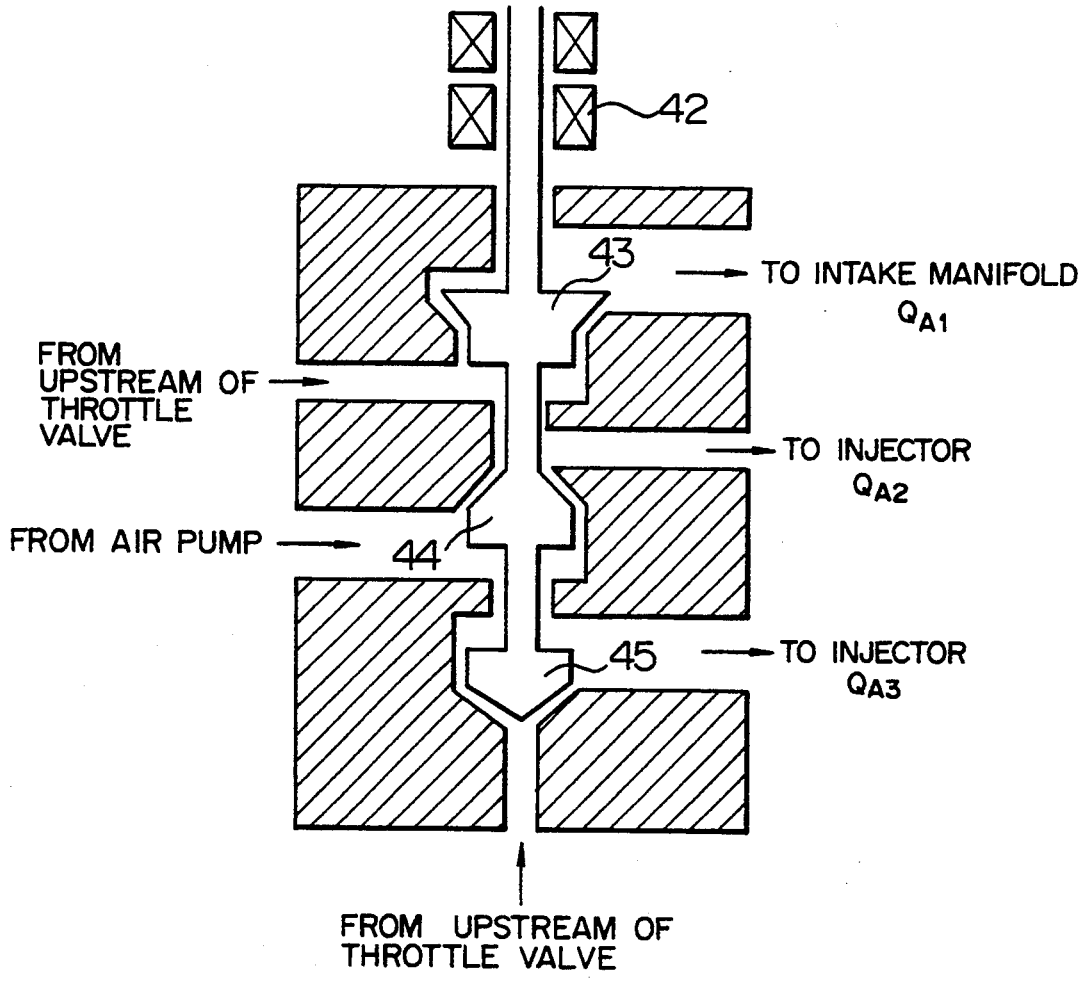
FIG. 36 is a sectional view of an integral construction of the air pump and an air control valve.
Figure 37:
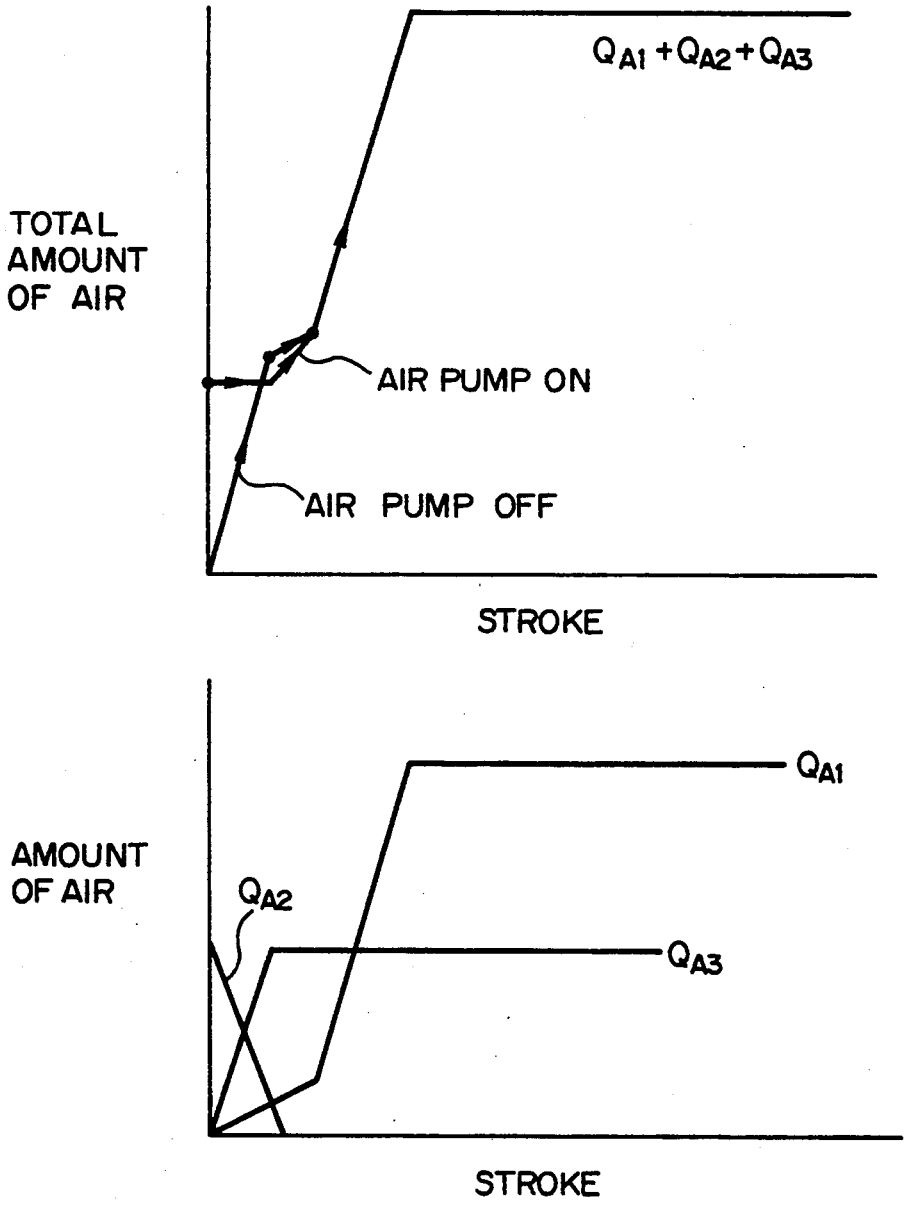
FIG. 37 is a characteristic chart showing operational characteristics of the air control valve.

FIG. 36 shows an example of integrated construction of the air control valve 18 and the ISCV 30. The positions of valves are controlled by a stepping motor 42. At a small stroke, a valve 45 is initially opened to supply an air amount $Q_{A3}$ from the upstream of the throttle valve to the air assisted fuel injection valve. By a greater stroke, a valve 43 is opened to supply an air amount $Q_{A1}$ from the upstream of the throttle valve to the intake manifold. By this, the engine idling speed can be controlled by adjusting the positions of the valves 43 and 45 with constantly supply the necessary amount of air to the air assisted fuel injection valve. While the air pump is driven, the valves are operated at the smaller stroke so that the pressurized air is supplied through a valve 44. With such construction, since the air pump side valve 44 and the valve 45, to which the air is supplied from the upstream of the throttle valve will never be opened simultaneously, overrunning of the engine can be successfully avoided for assuring safety. Either in operative state and inoperative state of the air pump, the air flow amount can be controlled by the stroke of the valves as shown in FIG. 37. The control to be performed can be duty control instead of the stroke control.

Reduction air flow amount while the air pump is held driving (ON) can be achieved by adjusting $Q_{A2}$, $Q_{A3}$ and the air amount characteristics. Alternatively, it is possible to reduce the air flow amount by adjusting the pump speed.

For promoting re-combustion of unburnt hydrocarbon in the catalytic converter in the exhaust pipe, the exhaust secondary air is introduced by means of the pump 25. Since introduction of the secondary air is required only after completion of combustion in the engine, when the air pump 2 is operated only during cranking, the air pump 2 may be used as the atomization air source during cranking and as the secondary air source otherwise. In such case, the air introduction as the secondary air is blocked during cranking for assisting rising of the air pressure.

Figure 38:
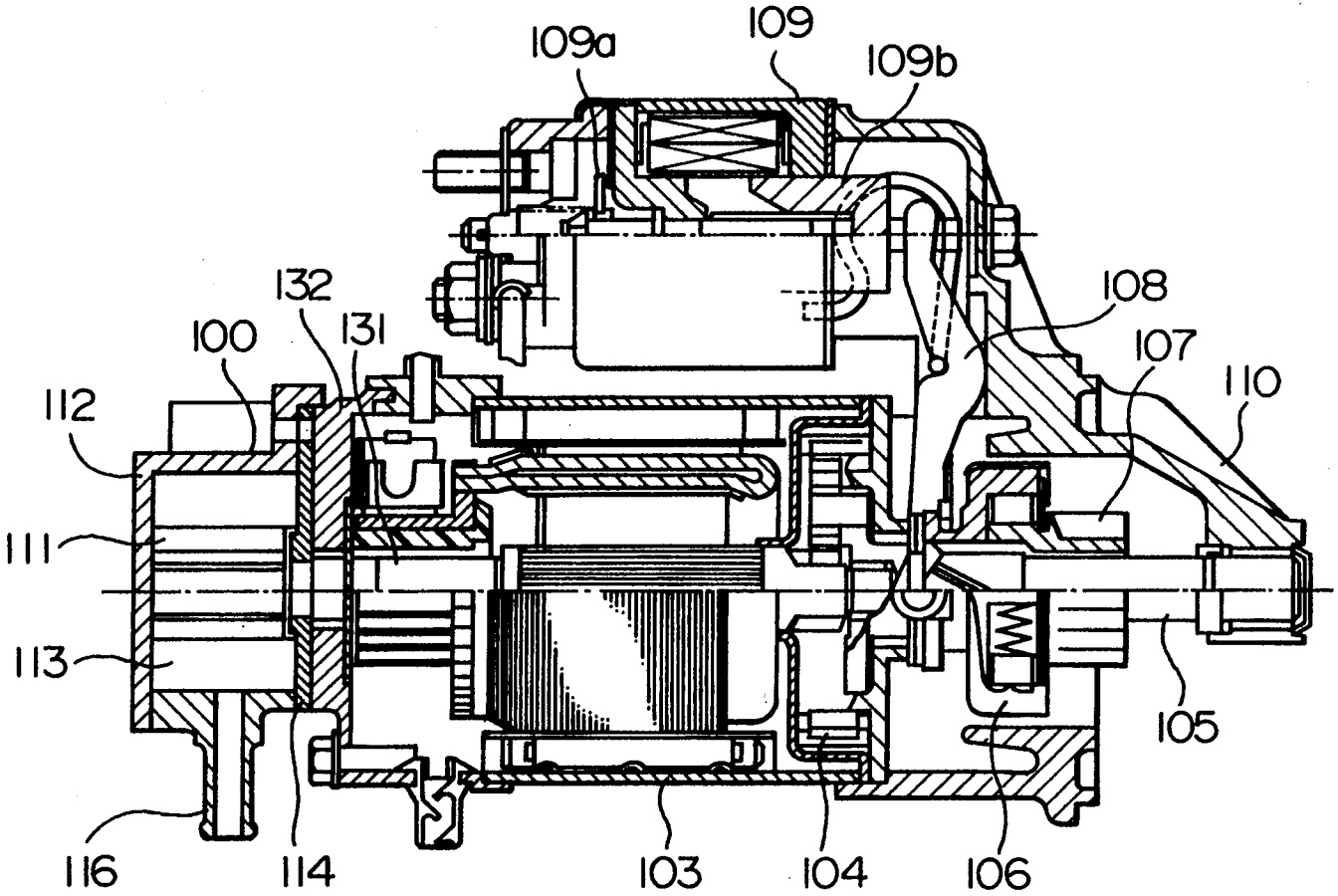
FIG. 38 is a sectional view showing the sectional construction of the starter motor and the air pump applicable to the present invention.
Figure 39:
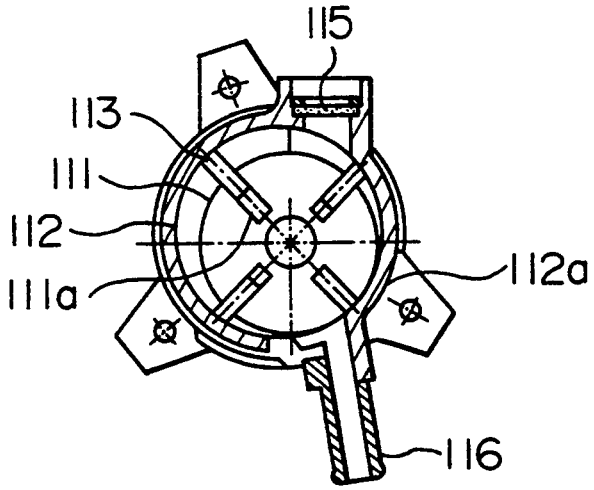
FIG. 39 is a sectional view of the air pump.

One embodiment of the present invention will be discussed hereinafter. In FIGS. 38 and 39, the shown embodiment comprises a starter motor main body which includes a motor 103, a reduction gear unit 104, a reduction gear shaft 105, an overrunning clutch 106, a pinion 107, a shift lever 108, a magnetic switch 109, and a gear casing 110, and a pump body 100 arranged at the side of the motor 103 opposite to the pinion. The pump main body 100 comprises a pump rotor 111, a pump housing 112, vanes 103, a side plate 114, an induction port 115, and a discharge port 116. The pump rotor 111 is coupled with an extended portion of a motor shaft 131 through a spline coupling or so forth so that it may be driven to rotate with the motor shaft 131. A plurality of vane receptacle grooves 111*a* are formed on the pump rotor 111 for receiving therein the vanes 113 in slidable fashion. The center of the inner periphery of the pump housing 112 is positioned at eccentric position relative to the center of the pump rotor 111 and mounted on an end bracket 132 of the motor 103 so as to define small gaps at portions of the pump housing. By rotation of the pump rotor 111, the vanes 113 are protruded radially outward due to centrifugal force and slidingly contact with the inner periphery of the pump housing 112. Since a space defined by the pump housing 112, the pump rotor 111 and the vanes 113 varies the volume according to the positions of the vanes, it performs pumping effect to introduce the air at the induction port 115 and discharge the air at the discharge port 116.

Although the shown embodiment employs the vane type pump construction, it is possible to employ a volume type pump, such as the piston type, the diaphragm type or so forth.

Figure 40:
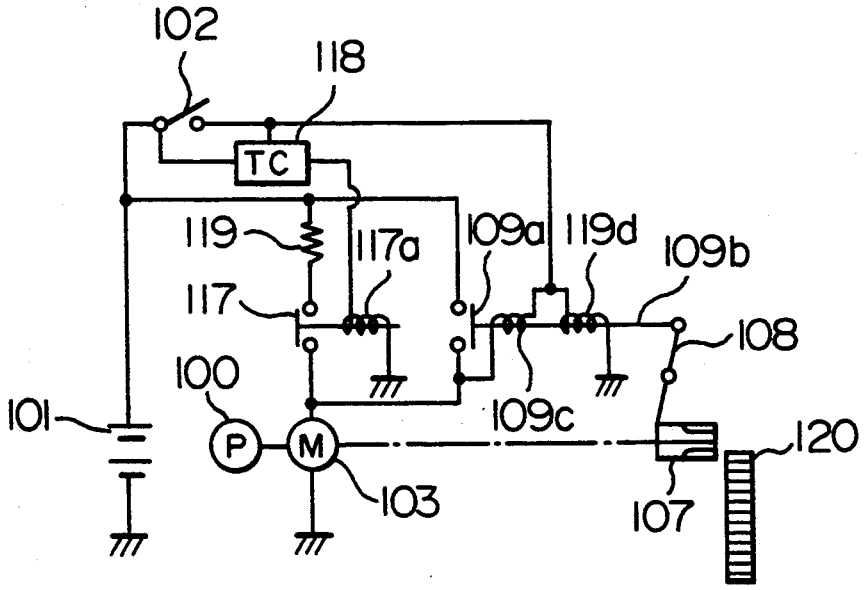
FIG. 40 is a circuit diagram of a control circuit for the starter motor.

Discussion will be given for an embodiment of an electric circuit with reference to FIG. 40. In FIG. 40, the reference numeral 101 denotes a battery and 102 denotes an ignition key switch. The reference numeral 109*a* denotes a main switch which is opened by a plunger 109*b* drawn by a sheath coil 109*c* and a shuttle coil 109*d*, and a not shown spring. One end of the shift lever 108 is pivotally coupled with one end of the plunger 109*b*. The other end of the shift lever 108 is pivotally coupled with the pinion 107. 117 denotes a main switch which is opened and closed by means of a solenoid 117*a*. 118 denotes a timer circuit which turns ON with a given delay period after turning on of the key switch 102 and subsequently turn off after a given period from on timing. 119 denotes a resistor and 120 denotes a ring gear.

Next, operation will be discussed. In response to turning on of the key switch 102, the current flows through the sheath coil 109*c* and the shuttle coil 109*d* to draw the plunger 109*b* to shift toward left. By pivotal motion of the shift lever 108, the pinion 107 is pushed toward right to engage with the ring gear 120. By the motion of the plunger 190*b*, the first main switch 109*a* is turned on to permit the current to flow through the motor 103 to drive the latter. By revolution of the motor, the ring gear 120 is driven via the reduction gear unit 104, the reduction gear shaft 105, the overrunning clutch 106 and the pinion 107. Thus, the not shown engine is driven for cranking. At the same time, the pump main body 100 is driven. Next, by the timer circuit 118, the current flows through the solenoid 117*a* with a given delay time after turning on of the key switch 102. Then, the second main switch 117 is turned on. When the key switch 102 is turned OFF after starting up of the engine, the plunger 109*d* is shifted toward right by a spring force of the not shown spring to turn off the first main switch 109*a*, and in conjunction therewith, to release engagement between the pinion 107 and the ring gear 120 for completing engine cranking operation. However, since the second main switch 117 is held ON state, the current flows through the motor 103 via the resistor 119 to drive the motor 103 at a predetermined speed. Therefore, only pump main body 100 is driven by the starter motor. The resistor 119 is provided a resistance necessary for obtaining the predetermined motor speed. At this condition, by further elapsing a time, the current for the solenoid 117 is shut off by the timer circuit 118, and the second main switch 117 is turned off. Then, the motor 103 is stopped revolution and thus the pump stops operation.

Although the shown embodiment performs energization control for the solenoid 117*a* by means of the timer circuit 118, the pump operation may be more proper when a control circuit performing energization control for the solenoid depending upon the operation demand for the pump 10.

Needless to say, the present invention can be implemented with similar or comparable effect to the disclosed construction and method not only by the constructions and methods as disclosed herein but also by various improvements and modifications therefor. Also, the present invention should not be specified to the control processes illustrated in the flowcharts but can employ any appropriate processes other than those disclosed.

As can be appreciated herefrom, according to the present invention, it becomes possible to drive the air pump for an arbitrarily selected period without complicate mechanical drive switching mechanism, and to achieve promotion of atomization of the fuel and reduction of pollutant in the exhaust gas.

What is claimed is:

1. A control circuit for an internal combustion engine including a cranking device and an air pump driven by a starter motor, comprising:

first circuit for supplying a power to the starter motor and the cranking device;

second circuit for terminating power supply for said cranking device with maintaining power supply for said starter motor; and control means for selectively switching between said first and second circuits.

2. A control circuit as set forth in claim 1, wherein said control means is responsive to turning ON of a cranking switch of the internal combustion engine for activating said first circuit and responsive to turning off of the cranking switch for activating said second circuit.

3. A control circuit as set forth in claim 2, wherein said control means maintains said second circuit in active state for a predetermined period after turning off of said cranking switch.

4. A control circuit as set forth in claim 2, wherein said internal combustion engine includes a catalytic converter and means for detecting a temperature of said catalytic converter, said control means includes means for making judgement that the temperature of said catalytic converter reaches a predetermined catalyst temperature, and said control means maintains said second circuit in active state until the temperature of said catalytic converter reaches said predetermined catalyst temperature.

5. A control circuit as set forth in claim 2, wherein said internal combustion engine includes means for detecting a temperature of an engine coolant, said control means includes means for making judgement that the engine coolant temperature reaches a predetermined coolant temperature, and said control means maintains said second circuit in active state until the engine coolant temperature reaches said predetermined coolant temperature.

6. A control circuit as set forth in claim 2, wherein said internal combustion engine includes means for detecting a pressure within an intake manifold, said control means includes means for making judgement that said pressure within the intake manifold becomes higher than a predetermined pressure level, and said control means activates said second circuit in response to said pressure in said intake manifold exceeding said predetermined pressure level.

7. A control circuit as set forth in claim 3, wherein said control means includes a timer circuit.

8. A control system for an internal combustion engine with an air pump, comprising:

a starter motor receiving power supply for performing cranking of the internal combustion engine while a cranking switch of the internal combustion engine is held on state;

an air pump driven by said starter motor for discharging an air; and power supply means for terminating cranking in response to turning off of said cranking switch with maintaining driving of said air pump.

9. A control system as set forth in claim 8, wherein said power supply means includes a first circuit for supplying a power to said starter motor while said cranking switch is held ON, a second circuit for supplying the power to said starter motor while said cranking switch is held OFF; and current limiting means for limiting a motor current flowing through said second circuit.

10. A control system as set froth in claim 9, wherein said current limiting means includes voltage limiting means disposed in series with said second circuit.

11. A control system as set forth in claim 10, wherein said voltage limiting means comprises a resistor element.

12. A control system as set forth in claim 11, wherein said internal combustion engine includes a catalytic converter in an exhaust passage, and said resistor element is arranged to heat said catalytic converter with the heat generated by the current flowing through said resistor element.

13. A control system as set forth in claim 11, wherein said resistor element is arranged to heat the air of said air pump with the heat generated by the current flowing through said resistor element.

14. A control system as set forth in claim 11, wherein said resistor element is arranged to heat a fuel passage of the internal combustion engine with the heat generated by the current flowing through said resistor element.

15. A control system as set forth in claim 10, wherein said voltage control means comprises a chopper circuit.

16. A control system as set forth in claim 10, which further comprises an atomizer means for aiding atomization of the injected fuel by injecting a discharge air of said air pump around a fuel injection nozzle of the internal combustion engine.

17. A control system as set forth in claim 16, wherein said internal combustion engine includes control circuit for intermittently injecting fuel through said fuel injection nozzle.

18. A control system as set forth in claim 17, wherein said control circuit provides a fuel injection interval for said fuel injection nozzle in synchronism with discharge period of the discharge air from said air pump.

19. A control system as set forth in claim 10, which further comprises means for injecting the discharge air of said air pump into an exhaust passage.

20. A control system as set forth in claim 19, wherein said means for injecting the discharge air includes a passage for introducing the discharge air into a catalytic converter disposed in said exhaust passage.

21. A control system as set forth in claim 16, which further comprises an air passage for introducing said discharge air into a catalytic converter disposed in an exhaust passage.

22. A control system as set forth in claim 21, which further comprises means for distributing the discharge air of said air pump to said atomizer means and said catalytic converter.

23. A control system as set forth in claim 21, wherein said air pump comprises a first air pump for supply discharge air to said atomizer means and a second air pump for injecting the discharge air into said catalytic converter.

24. A control system as set forth in claim 11, which further comprises means for supplying air around said starter motor into an air inlet of said air pump.

25. A control system as set forth in claim 16, which further comprises a control valve for adjusting air amount to be introduced into said air pump.

26. A control system as set forth in claim 25, wherein said atomizer means includes an air passage having a control valve arranged in parallel relationship to the passage for delivering the discharge air of said air pump.

27. A control system as set forth in claim 26, which further comprises a controller for controlling air amount passing through both of said control valves.

28. A control system as set forth in claim 27, wherein said both control valves are formed integrally.

29. A control system for an air pump of an internal combustion engine, comprising:

a motor for revolution in response to power supply;

cranking means responsive to a power supply for transmitting revolution of said motor to a rotary shaft of said internal combustion engine;

an air pump driven by revolution of said motor for discharging air; and circuit means for terminating power supply for said cranking means with maintaining power supply for said motor.

30. A control system as set forth in claim 29, wherein said cranking means comprises an electromagnetic actuator, a pinion gear activated by said electromagnetic actuator to be driven for rotation by said motor, and a ring gear for transmitting rotation of said pinion gear to said rotary shaft of said internal combustion engine.

31. A control system as set forth in claim 30, wherein said motor and said air pump are constructed integrally with securing the rotary shaft of said air pump at the axial end of said motor at the side opposite to the other end, on which said pinion is mounted.

32. A method for controlling an internal combustion engine including a cranking device and an air pump driven by a starter motor; comprising the steps of:

supplying a power to said starter motor and said cranking device; and terminating power supply for said cranking device with maintaining power supply for said starter motor.

33. A method as set forth in claim 32, wherein the power is supplied to said starter motor and said cranking device in response to turning ON of a cranking switch and the power supply for said cranking device is terminated with maintaining power supply for said starter motor in response to turning OFF of said cranking switch.

34. A method as set forth in claim 33, wherein the power supply for said cranking device is terminated with maintaining power supply for said starter motor for a predetermined period after turning OFF of said cranking switch.

35. A method as set forth in claim 33, which further comprises steps of step for detecting a temperature of a catalytic converter of said internal combustion engine and step for making judgement that the temperature of said catalytic converter reaches a predetermined catalyst temperature, and the power supply for said cranking device is terminated with maintaining power supply for said starter motor until the temperature of said catalytic converter reaches said predetermined catalyst temperature.

36. A method as set forth in claim 33, which further comprises steps of step for detecting a temperature of an engine coolant and step for making judgement that the temperature of said engine coolant reaches a predetermined coolant temperature, and the power supply for said cranking device is terminated with maintaining power supply for said starter motor until the temperature of said engine coolant reaches said predetermined coolant temperature.

37. A method as set forth in claim 33, which further comprises steps of step for detecting a pressure in an intake manifold and step for making judgement that the pressure in said intake manifold becomes higher than a predetermined pressure, and the power supply for said cranking device is terminated with maintaining power supply for said starter motor when said pressure in the intake manifold exceeds said predetermined pressure.

* * * * *